US008035293B2

(12) United States Patent
Popovich

(10) Patent No.: US 8,035,293 B2
(45) Date of Patent: Oct. 11, 2011

(54) COLD-CATHODE LIGHT-EMITTING DEVICE WITH DEFOCUSING GRID AND ASSOCIATED METHODS OF MANUFACTURING

(75) Inventor: Stalimir Popovich, North Redington Beach, FL (US)

(73) Assignee: Vu1 Corporation, Seattle, WA (US)

( * ) Notice: Subject to any disclaimer, the term of this patent is extended or adjusted under 35 U.S.C. 154(b) by 732 days.

(21) Appl. No.: 11/303,810

(22) Filed: Dec. 16, 2005

(65) Prior Publication Data

US 2006/0132048 A1 Jun. 22, 2006

Related U.S. Application Data

(60) Provisional application No. 60/637,069, filed on Dec. 16, 2004.

(51) Int. Cl.
*H01J 1/00* (2006.01)
*H01J 1/02* (2006.01)
*H01J 1/62* (2006.01)

(52) U.S. Cl. ..... 313/496; 313/491; 313/495; 313/309; 313/310

(58) Field of Classification Search ..... None
See application file for complete search history.

(56) References Cited

U.S. PATENT DOCUMENTS 4,352,043 A 9/1982 Rigden
4,506,191 A 3/1985 Takenobu
5,552,659 A 9/1996 Macaulay et al.
5,656,887 A 8/1997 Voshell et al.
5,949,185 A * 9/1999 Janning ..... 313/495
5,965,977 A 10/1999 Makishima
5,986,399 A 11/1999 Van Veen et al.
6,081,246 A 6/2000 Cathey et al.
(Continued)

FOREIGN PATENT DOCUMENTS

EP 0035828 A 9/1981
(Continued)

OTHER PUBLICATIONS

International Search Report and Written Opinion issued in related PCT Patent Application Serial No. PCT/US2008/053094, 16 pages, Jun. 6, 2008.

(Continued)

*Primary Examiner* — Anne Hines
*Assistant Examiner* — Tracie Green
(74) *Attorney, Agent, or Firm* — Lathrop & Gage LLP

(57) ABSTRACT

A light emitting device has an enclosure with a face portion, a cold cathode within the enclosure, a phosphor layer disposed on an interior surface of the face portion, an extracting grid between the cold cathode and the phosphor layer and a defocusing grid between the extracting grid and the phosphor layer. Electrons emitted from the cold cathode are defocused by the defocusing grid and impact the phosphor layer when an electric field is created between the cold cathode and the phosphor layer due to applied voltages at the cold cathode, extracting grid, defocusing grid and phosphor layer. The phosphor layer emits light through the face portion in response to electrons incident thereon. Secondary electron emission may also occur resulting in increased electron impact upon the phosphor layer, thereby increasing light output. A mirror layer may be included to reflect light toward the face portion of the light emitting device. The mirror layer also inhibits low energy electrons from impacting the phosphor, thereby enhancing the blink rate of the light emitting device.

30 Claims, 22 Drawing Sheets

U.S. PATENT DOCUMENTS

| | | | | |
|---|---|---|---|---|
| 6,268,691 | B1 | 7/2001 | Takemura et al. | |
| 6,354,898 | B2 | 3/2002 | Kim | |
| 6,354,989 | B1 | 3/2002 | Nudeshima | |
| 6,404,136 | B1 | 6/2002 | Murray et al. | |
| 6,441,550 | B1 * | 8/2002 | Patterson et al. | 313/495 |
| 6,504,311 | B1 | 1/2003 | Kumar et al. | |
| 6,614,149 | B2 | 9/2003 | Kastalsky et al. | |
| 2001/0040430 | A1 * | 11/2001 | Ito et al. | 313/496 |
| 2002/0117953 | A1 * | 8/2002 | Kuo et al. | 313/310 |
| 2003/0011292 | A1 | 1/2003 | Espinosa | |
| 2003/0230986 | A1 * | 12/2003 | Horsky et al. | 315/111.81 |
| 2005/0156506 | A1 | 7/2005 | Chung et al. | |

FOREIGN PATENT DOCUMENTS

| | | | |
|---|---|---|---|
| EP | 0599202 | A | 6/1994 |
| GB | 2070849 | A | 9/1981 |
| GB | 2097181 | A | 10/1982 |
| WO | 2006066111 | A | 6/2006 |

OTHER PUBLICATIONS

International Search Report and Written Opinion issued in related PCT Patent Application Serial No. PCT/US2008/053100, 17 pages, Aug. 4, 2008.

International Search Report and Written Opinion issued in related PCT Patent Application Serial No. PCT/US2005/45713, 12 pages, Jun. 12, 2008.

Office Action issued in related U.S. Appl. No. 11/684,303, 15 pages, Jun. 11, 2008.

Extended Search Report issued in related 05854433.9 dated Aug. 19, 2010, 10 pages.

Response to Extended Search Report issued in related 05854433.9 dated Mar. 16, 2011, 14 pages.

Office Action issued in related Chinese Application No. 200580045147.1 on Aug. 9, 2010, 24 pages.

* cited by examiner

COLD-CATHODE LIGHT-EMITTING DEVICE WITH DEFOCUSING GRID AND ASSOCIATED METHODS OF MANUFACTURING

RELATED APPLICATIONS

This application claims priority to U.S. Provisional Ser. No. 60/637,069, filed Dec. 16, 2004, and incorporated herein by reference.

BACKGROUND

Lights for displays such as advertising, signage, signals or emergency signaling are typically of two types: incandescent and light emitting diodes (LED). Each of these types of lights has drawbacks that make them undesirable in certain applications. For example, although incandescent lights are readily available in various colors, and are able to emit bright light viewable from substantially any angle, incandescent lights also produce a substantial amount of heat in comparison to quantity of light emitted. Thus, the heat generation of incandescent lights wastes electrical power.

Alternatively, LEDs produce a relatively low amount of heat in comparison to the light emitted, and thus use substantially less electrical power as compared to incandescent lights. However, there are numerous restrictions on LEDs. For example, LEDs are typically circular or cylindrical; and it is not cost-effective for LEDs to be manufactured in an alternative shape that is better suited to a particular lighting application. Additionally, white light or multiple-color LEDs are not yet cost-effectively manufactured. LEDs also have relatively slow blink rates (e.g., 5 kHz) which causes a video display of sixty-four or higher levels of brightness to be distorted, for example, making it difficult or impossible to create animated displays with arrays of LEDs. Further, LEDs have a relatively narrow emission angle within which emitted light is effectively viewed—typically a maximum of 120 to 130 degrees.

FIG. 1 shows a pixel 2 of a prior art display (e.g., a billboard); pixel 2 is shown with a cluster of nine individual LEDs 4. Pixel 2 is commonly used where larger or brighter pixels are required; that is, by clustering LEDs 4 within pixel 2 and operating all LEDs 4 simultaneously, increased luminosity may be achieved. However, since LEDs 4 are round in shape, the illuminated area of pixel 2 (i.e., the sum of circular emission areas of LEDs 4) is less than the area of pixel 2 and therefore optimum pixel brightness is not obtained.

SUMMARY

In one embodiment, a light emitting device has an enclosure with a face portion, a cold cathode within the enclosure, a phosphor layer disposed on an interior surface of the face portion, an extracting grid between the cold cathode and the phosphor layer and a defocusing grid between the extracting grid and the phosphor layer. Electrons emitted from the cold cathode are defocused by the defocusing grid and impact the phosphor layer when an electric field is created between the cold cathode and the phosphor layer due to applied voltages at the cold cathode, extracting grid, defocusing grid and phosphor layer. The phosphor layer emits light through the face portion in response to electrons incident thereon.

In another embodiment, a light emitting device has an enclosure with a face portion; a cold cathode within the enclosure, the cold cathode having a convex or concave shape, a phosphor layer disposed on an interior surface of the face portion and an extracting grid between the cold cathode and the phosphor layer. The extracting grid has a convex or concave shape and is formed to have a uniform distance from a surface of the cold cathode. Electrons emitted from the cold cathode impact the phosphor layer when an electric field is created between the cold cathode and the phosphor layer due to applied voltages at the cold cathode, extracting grid and phosphor layer. The phosphor layer emits light through the face portion in response to electrons incident thereon.

In another embodiment, a display system has an array of light emitting devices, a display controller electrically connected to each of the light emitting devices, wherein the display controller controls brightness of each of the light emitting device. Each of the light emitting devices has an enclosure with a face portion, a cold cathode within the enclosure, a phosphor layer disposed on an interior surface of the face portion, an extracting grid between the cold cathode and the phosphor layer and a defocusing grid between the extracting grid and the phosphor layer. Electrons emitted from the cold cathode are defocused by the defocusing grid and impact the phosphor layer when an electric field is created between the cold cathode and the phosphor layer by applied voltages to the cold cathode, extracting grid, defocusing grid and phosphor layer. The phosphor layer emits light through the face portion in response to impact of the electrons thereon.

In another embodiment a display system has an array of light emitting devices, each light emitting device capable of producing light of variable color and brightness and a display controller electrically connected to each of the light emitting devices. The display controller provides a plurality of electrical potentials to each of the light emitting devices to control color and brightness of the light emitting device. Each of the light emitting devices has an enclosure with a face portion, a cold cathode within the enclosure, a phosphor layer disposed on an interior surface of the face portion, an extracting grid between the cold cathode and the phosphor layer, and a defocusing grid between the extracting grid and the phosphor layer. Electrons from the cold cathode are defocused by the defocusing grid and impact the phosphor layer when an electric field is created between the cold cathode and the phosphor layer by applied voltages to the cold cathode, extracting grid, defocusing grid and phosphor layer. The phosphor layer emits light through the face portion in response to impact of the electrons thereon.

In another embodiment, a method generates light, including: generating an electric field to extract electrons in the form of an electron beam from a cold cathode, and modifying the electric field to defocus the electron beam such that electrons evenly impact a phosphor layer to emit light therefrom.

DETAILED DESCRIPTION OF THE FIGURES

Figure 2:
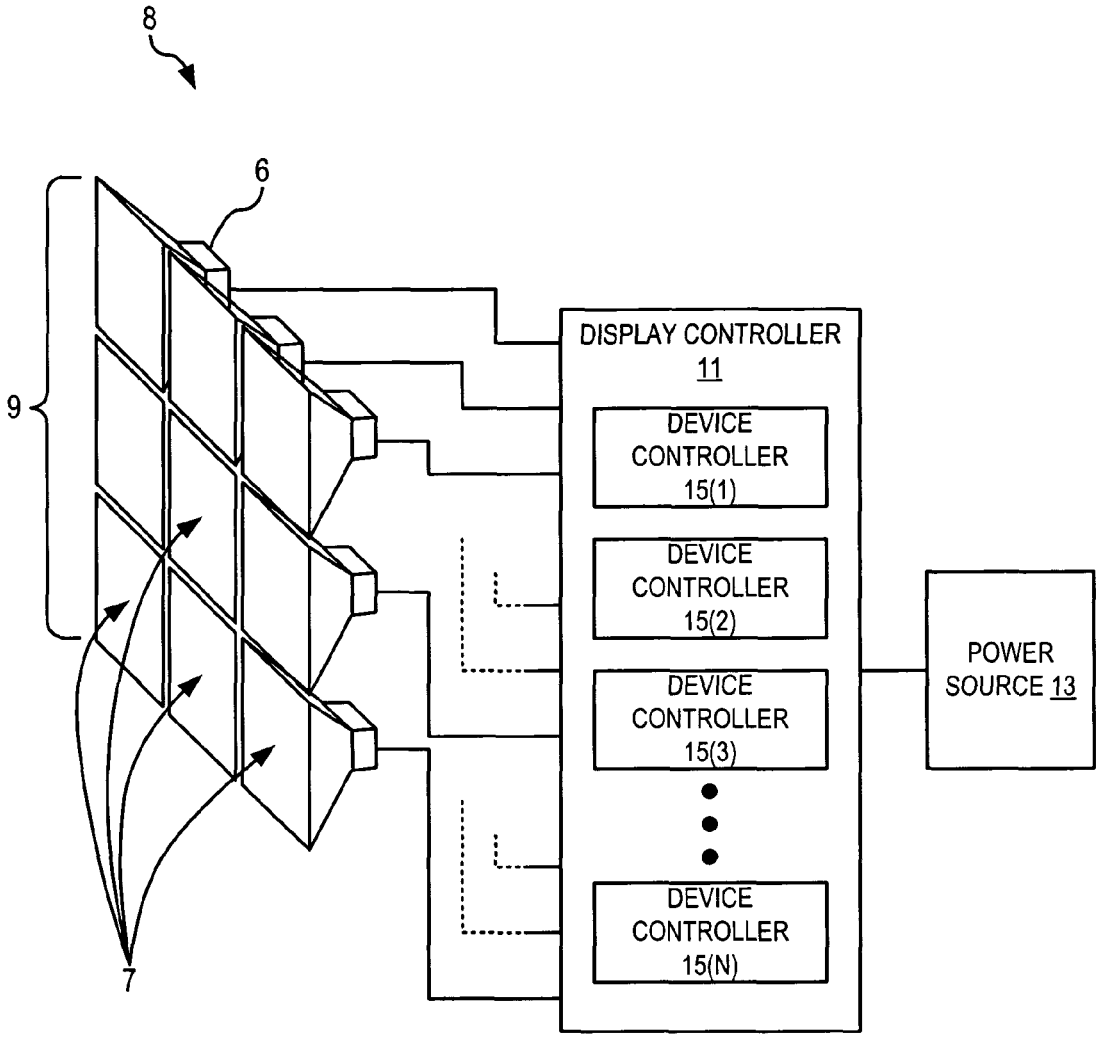
FIG. 2 shows a display system with a plurality of light emitting devices and a display controller, in accord with one embodiment.

FIG. 2 shows a display system 8 with a light emitting display 9 that is illustratively shown with nine pixels 7 and a display controller 11. Each pixel 7 of display 9 has a light emitting device 6 that provides illumination for the pixel 7. Display controller 11 has a plurality of device controllers 15(1-N) that each control one or more of light emitting devices 6. A power source 13 provides power to display controller 11 which distributes the power to device controllers 15. Each light emitting device 6 may be constructed to emit a single color, or may be constructed to emit a plurality of colors under control of device controller 15. These light emitting devices may take the form of light emitting devices described in the following figures.

Figure 3:
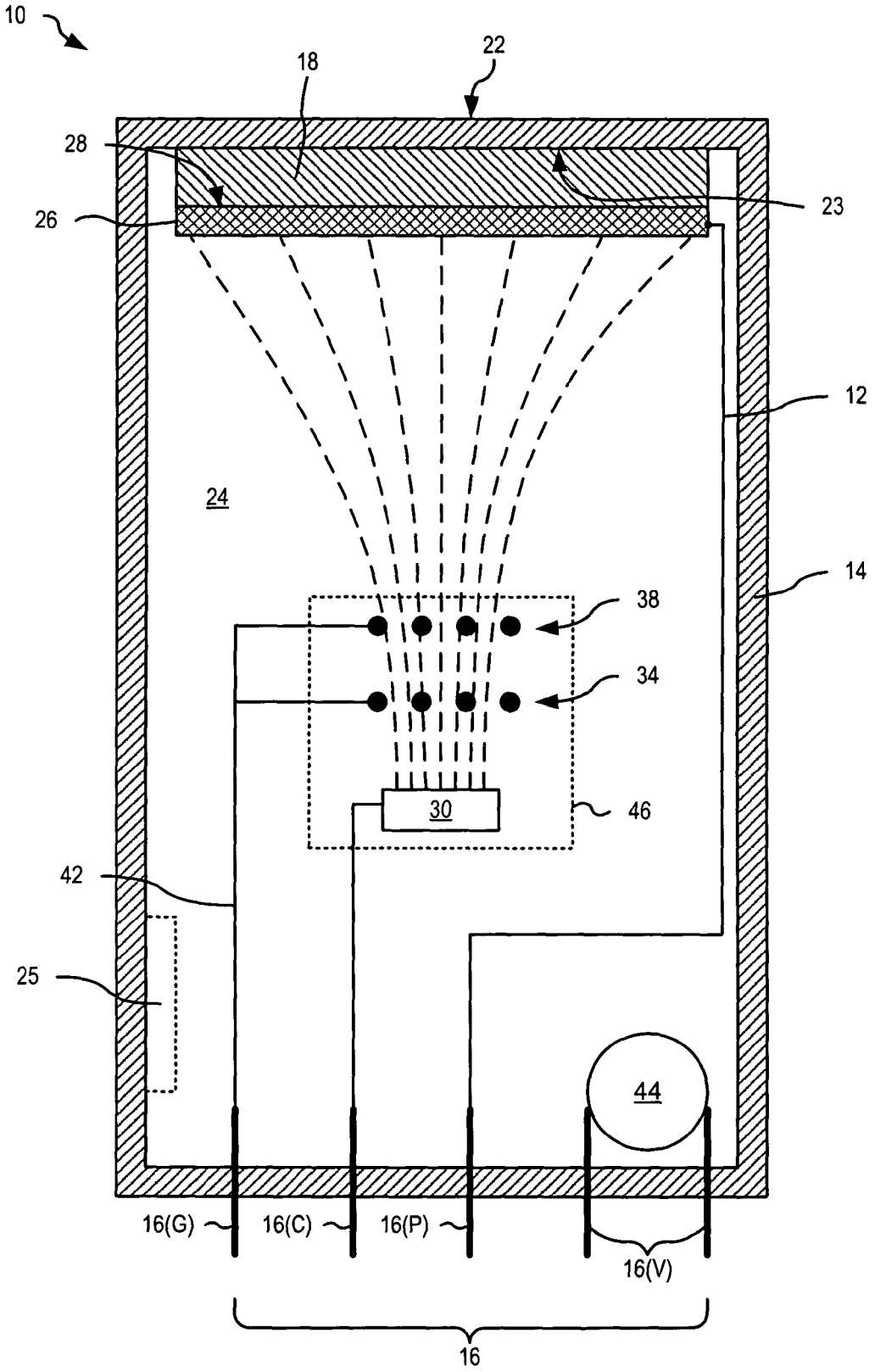
FIG. 3 shows a cross section of one embodiment of a light emitting device.

FIG. 3 shows one light emitting device 10. Light emitting device 10 may, for example, form light emitting device 6, FIG. 2. Light emitting device 10 includes an enclosure 14 which, except for electrical conductors 16, encloses electrical components of light emitting device 10; conductors 16 extend through enclosure 14 to provide electrical connectivity to various components within the interior of enclosure 14, such as shown. Enclosure 14 may be constructed from glass. Enclosure 14 has a face portion 22 from which light emits from light emitting device 10. Although face portion 22 is shown flat in FIG. 3, it may instead form a hemispherical or other three-dimensionally curved surface (see, for example, FIGS. 10, 11, 12, 14, 15 and 16). A layer of phosphor 18 is deposited on an interior side 23 of face portion 22 (i.e., within enclosure 14 and adjacent face portion 22). Phosphor layer 18 may be sandwiched between interior side 23 and a mirror layer 26, wherein a surface 28 of mirror layer 26 adjacent and nearest to phosphor 18 reflects light emitted by phosphor layer 18 during operation of light emitting device 10. The brightness of light emitting device 10 may increase by 200%, for example, due to reflection, by mirror layer 26, of light emitted by phosphor layer 18. Mirror layer 26 may be made from aluminum, aluminum alloy, or other functionally equivalent material.

Light emitting device 10 also includes a cold cathode 30 that operates to provide a source of electrons that excite phosphor 18, which in turn emits light. Cold cathode 30 is an electron emission source that substantially remains at ambient temperature (typically within X degrees of ambient temperature) during electron emission, and, therefore, is not a significant source of heat generation. Cold cathode 30 is for example formed by chemical vapor deposition (CVD), wherein a carbon material is deposited to a conductive film, as discussed further below.

An extracting grid 34 and a defocusing grid 38 are located between cold cathode 30 and mirror layer 26. Extracting grid 34 provides an electrical field that accelerates electrons emitted from cold cathode 30 towards phosphor 18, as described in further detail below. Defocusing grid 38 is located between extracting grid 34 and mirror layer 26, as shown, and operates to expand (i.e., defocus) the electron beam such that a substantially uniform distribution or density of electrons impact the entire area of phosphor 18 (by traveling through mirror layer 26). Note that extracting grid 34 and defocusing grid 38 may be, approximately, at the same voltage, since both are connected to control pin 16(G) by conductor path 42; therefore, in the embodiment of FIG. 3, the electrons traveling through extracting grid 34 toward defocusing grid 38 are not substantially accelerated by defocusing grid 38.

Sealed interior 24 of light emitting device 10 is evacuated to a vacuum of approximately $10^{-4}$ to $10^{-6}$ Torr (or a wider vacuum range of, e.g., $10^{-2}$ to $10^{-8}$). Light emitting device 10 may include an active getter 44 that is operated by applying electricity to pins 16(V) to establish and/or maintain vacuum within light emitting device 10. A getter material 25 that removes gas by sorption may be included within device 10 to maintain the vacuum therein.

Mirror layer 26 and/or phosphor 18 have an electrical conductive path 12 that provides connectivity to pin 16(P). Conductor 12 may, for example, be insulated to prevent unwanted electron attraction and interaction.

Device 10 may be constructed by various techniques, such as the prototype configuration described in connection with FIGS. 23 and 24.

Electrons are extracted from cold cathode 30 by application of an electric field, created, for example, by applying a potential difference between cold cathode 30 and extraction grid 34. The electric field strength is therefore dependent upon the physical distance and the potential difference between cold cathode 30 and extraction grid 34. A lower limit on this electric field for extracting electrons from cold cathode 30 is approximately $2^{-10}$ volts/micron, determined experimentally.

In an example of operation, a potential difference of approximately 200V between cold cathode 30 and extracting grid 34 is created by maintaining cold cathode 30 at −200 volts and extracting grid 34 (and defocusing grid 38) at ground (i.e., 0V).

In another example of operation, pin 16(C) is grounded (i.e., 0V is applied to cold cathode 30) and +210 volts is applied continuously to pin 16(G), such that both extracting grid 34 and defocusing grid 38 are maintained at +210 volts. In this later configuration, extracting grid 34 is an anode with partial flow-through capability.

Nonetheless, various voltage differentials between cathode 30 and extracting grid 34 may be used operationally. In one example, a voltage differential of approximately 500 volts between cathode 30 and extracting grid 34 may be used (for example, extracting grid 34 is maintained at +500 volts with cathode 30 grounded, or extracting grid 34 is grounded and cathode 30 at maintained at −500 volts, or extracting grid 34 may be maintained at −250 volts with cathode 30 is maintained at +250 volts). In another operational example, the voltage of cathode 30 is maintained at −100V with extracting grid 34 maintained at a voltage between +300V to +400V. In still another example of operation, cathode 30 is maintained at a voltage of +100V with extracting grid 34 is maintained at a voltage of +500V.

Once electrons are extracted from cold cathode 30, these electrons may be accelerated towards phosphor 18 by a second electric field created by applying a positive (relative to the voltage applied to cold cathode 30) voltage to mirror layer 26 and/or phosphor 18. In one example of operation, a continuous high electrical potential in the range of +5 kV to +15 kV (for example +10 kV has been tested to function well) is applied to pin 16(P), and hence to mirror layer 26 and phosphor 18; this high electrical potential further accelerates electrons emitted by cold cathode 30 toward phosphor 18.

Figure 4:
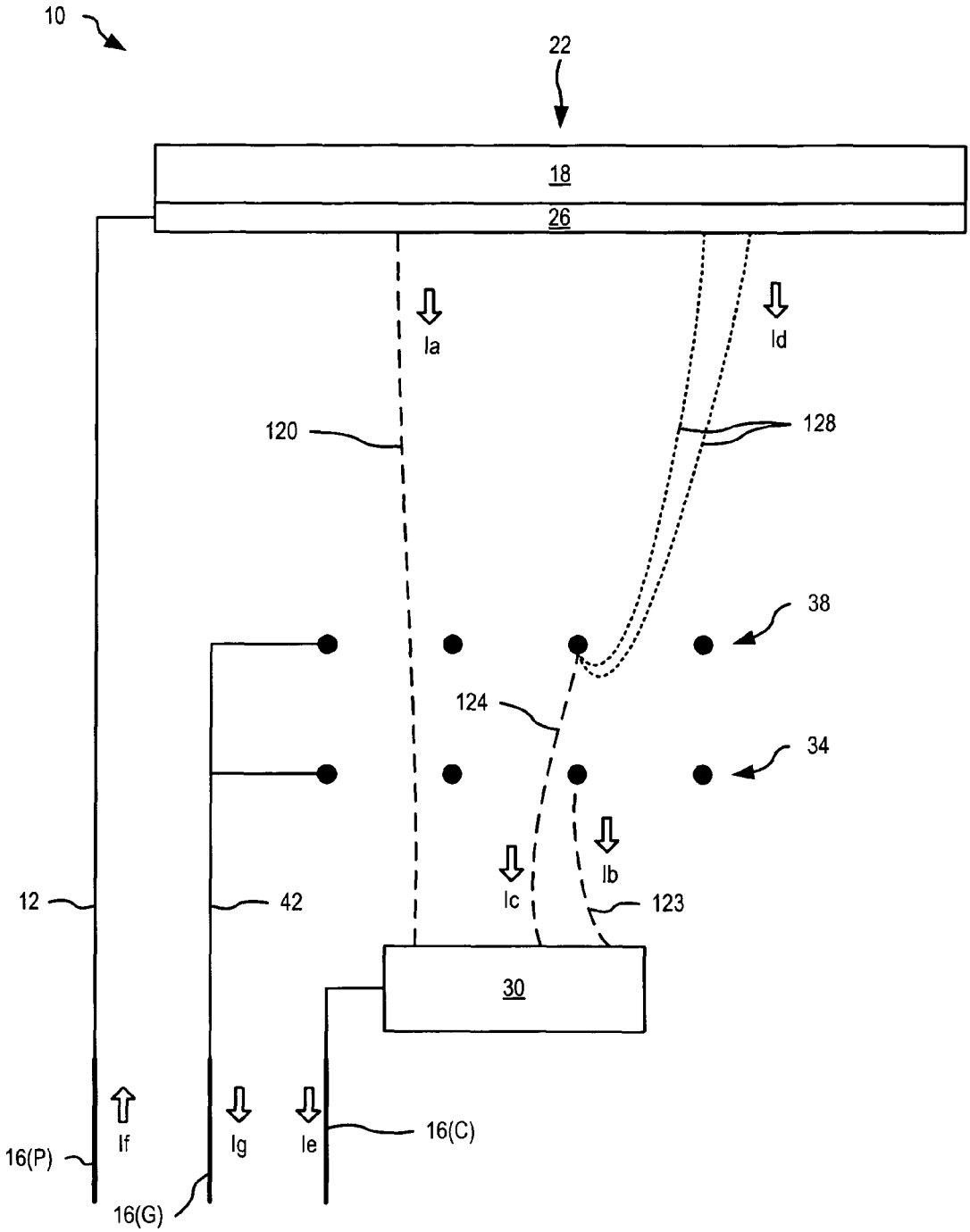
FIG. 4 shows exemplary electron behavior within the light emitting device of FIG. 3, illustrating secondary electron emissions from the defocusing grid.

FIG. 4 shows exemplary electron behavior within light emitting device 10. Enclosure 14 is not shown in FIG. 4 for clarity of illustration. Line 120 indicates one exemplary electron trajectory from cold cathode 30 to phosphor 18 (through mirror layer 26) and is indicative of a primary emission that results in a current Ia. Exemplary electron trajectory 124 is absorbed by defocusing grid 38, resulting in a current Ic. As a result of this absorption, defocusing grid 38 emits two additional electrons, as indicated by electron trajectories 128; these lines 128 represent exemplary secondary emissions from defocusing grid 38 to phosphor 18 (through mirror layer 26), resulting in a current Id. Exemplary electron trajectory 123 results when primary electrons are absorbed by extraction grid 34, resulting in a current Ib.

In one example of operation, cold cathode 30 provides a current (Ie) of 60 microamperes. Extracting grid 34 absorbs the resulting electrons to produce a current of 20 microampere (Ib). Defocusing grid 38 absorbs electrons resulting in a current of 13 microamperes (Ic). The primary current flow (Ia) to phosphor 18 is therefore only 60−20−13=27 microamperes; however, test results indicate that phosphor 18 receives 80 microamperes. Therefore, fifty-three microamperes (Id) result from secondary electron emission from defocusing grid 38. Accordingly, defocusing grid 38 emits an electron current of 53 microamperes to phosphor 18 by absorbing an electron current of 13 microamperes, providing an emission ratio rate of approximately 4:1 (53:13). The secondary emission ratio may be increased by plating defocusing grid 38 with a potent secondary electron emissive material.

Without being bound to any particular theory, it is believed that a greater distance between extracting grid 34 and defocusing grid 38 increases the dispersion of the electron beam, and thus increases the area of phosphor 18 generating light.

Since, in this example, grids 34 and 38 are electrically connected together, only one driver and one conductor through enclosure 14, is required to vary the voltage at both extracting grid 34 and defocusing grid 38. Moreover, the low constant electric field between both grids 34 and 38 prevents aggressive removal of carbon particles from the cold cathode 30. Such removal of carbon particles from cathode 30 may have an adverse effect on operation of light emitting device 10 (e.g., by creating parasitic electron emission). Thus, light emitting device 10 is expected to have a long life expectancy, e.g., approximately a 30,000 hour life or longer.

In operation, a continuous high voltage (e.g., +10 kV) is provided to phosphor 18 and/or mirror layer 26 such that a high level of brightness is transmitted through face portion 22 of light emitting device 10. In at least some embodiments, light emitting device 10 may therefore produce brightness in the range of at least 10,000 to 25,000 nits, and may produce up to 100,000 nits (or more) in certain embodiments. The continuous high voltage provides high electron energy for primary electron emission from cold cathode 30 as well as the secondary defocusing grid 38 emissions that impact phosphor 18. However, in at least some embodiments, electrical power density of phosphor layer 18 (assuming phosphor 18 represents an average CRT phosphor) should not exceed 0.4 $W/cm^2$ since there may be an efficiency drop in luminance for the power consumed of approximately 10% to 30% due to over saturation and thermal suppression. Excessive electrical power may generate additional heat at phosphor layer 18, increasing its electrical resistance. Accordingly, an average current density at phosphor layer 18 may be J=0.4 $W/cm^2$/10 kV. Average current density at phosphor layer 18 may, for example, vary from 10 $\mu A/cm^2$ to 60 $\mu A/cm^2$, and electrical power density may, for example, vary between 0.1 $W/cm^2$ and 0.6 $W/cm^2$.

As discussed above, mirror layer 26 increases brightness of light emitting device 10. However, mirror layer 26 also acts as an electron barrier for low energy level electrons; electrons with energy below approximately +6 kV are unlikely to penetrate mirror layer 26 to reach phosphor 18, any electrons that penetrate mirror layer 26 have, for example, an energy of +10 kV or greater.

For a high power device, a high voltage phosphor that operates at a voltage of up to 40 kV may be used. By using the high voltage phosphor with a voltage of 36 kV, for example, a current density of up to 160 $\mu A/cm^2$ may be achieved. Such an embodiment may require a high temperature glass and other high temperature components. When a white phosphor is used, the average brightness of the embodiment may achieve a light output of 130,000 nits (i.e., cd/$m^2$).

Multi-Phosphor Light Emitting Devices

Figure 5:
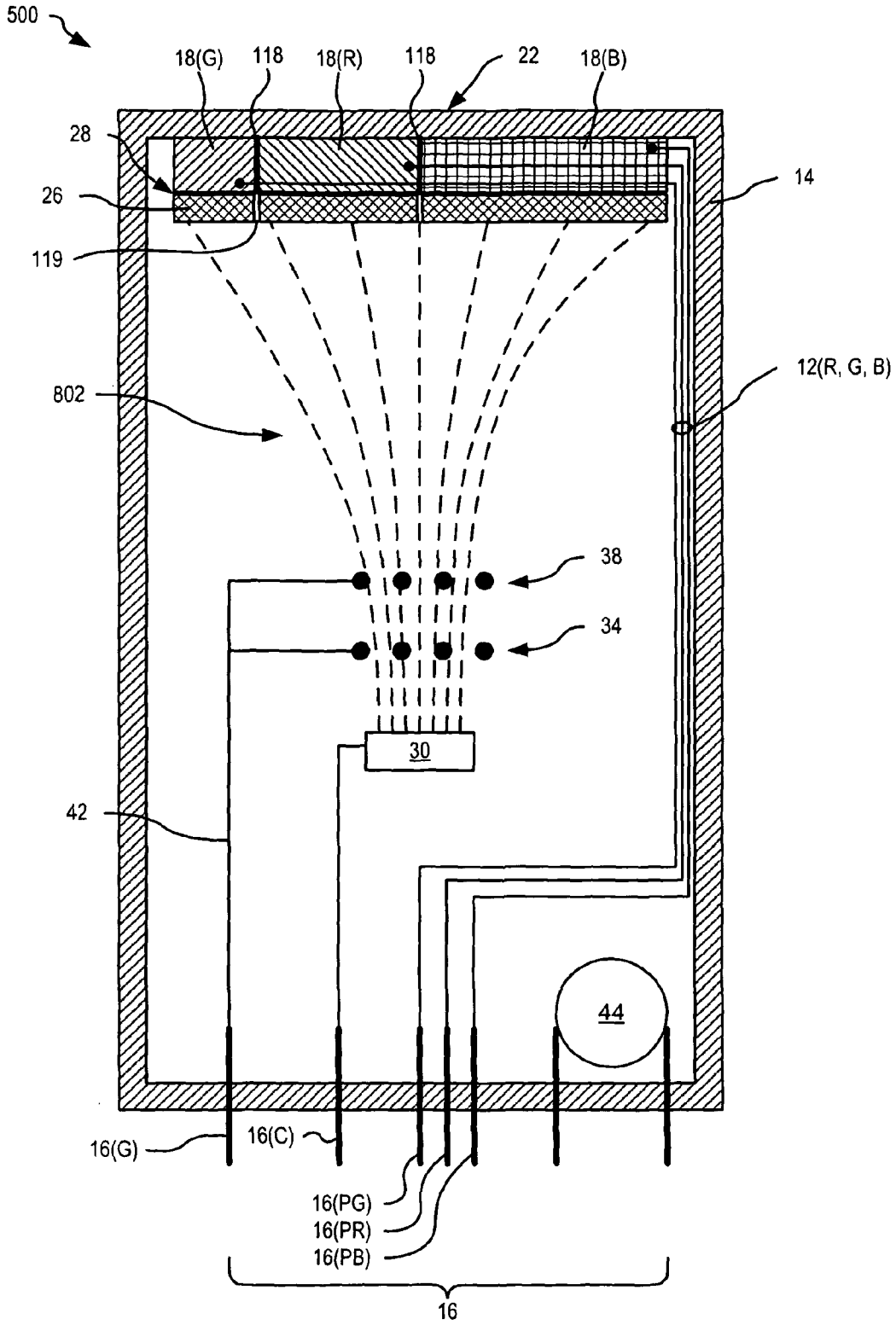
FIG. 5 shows one exemplary multi-color light emitting device with three different phosphors that generate red, green and blue light, in accord with one embodiment.
Figure 6:
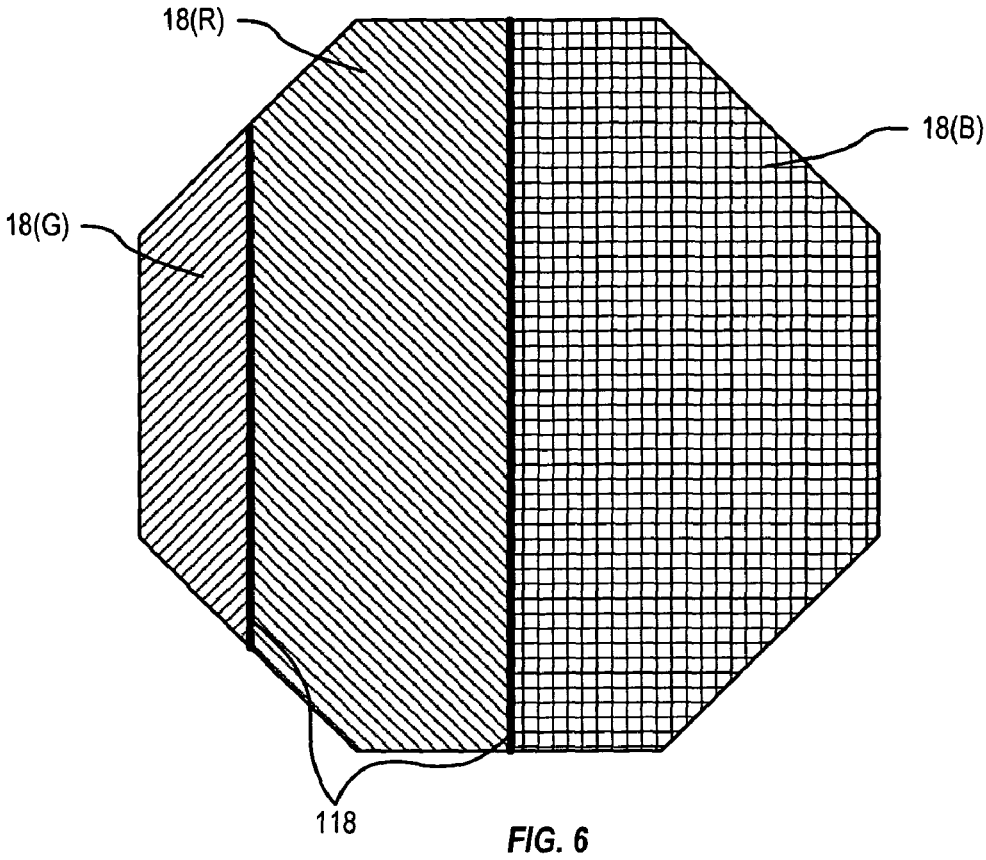
FIG. 6 shows one exemplary face-on view of the light emitting device of FIG. 5.

FIG. 5 shows one exemplary light emitting device 500 with three different phosphors 18 (R), 18(G) and 18(B) for generating red, green and blue light, respectively. Light emitting device 500 may, for example, represent light emitting device 6, FIG. 2. An exemplary face-on view of light emitting device 500 is shown in FIG. 6. In this embodiment, phosphor 18(G) is separated from phosphor 18(R) by a non-conductive insulator 118, and phosphor 18(R) is separated from phosphor 18(B) by another non-conductive insulator 118. The width of non-conductive insulator 118 between different phosphors 18 may be approximately 0.01 mm to 0.5 mm, or approximately 0.02 mm to 0.05 mm. In one embodiment, each such insulator 118 may instead be a space or gap between different phosphors 18 within the internal vacuum of light emitting device 500; in another embodiment, the insulator and/or space 118 may include an etching of the glass between the different phosphors 18 to assure electrical separation. In still other embodiments, the insulator and/or space 118 includes a glass ridge or another non-conductive material such as a ceramic, aluminum oxide etc.

Each phosphor layer 18 is coated with a mirror layer 26 that has insulating gaps 119 that are aligned with insulators 118 such that each mirror layer 26 covering each of the phosphor 18 areas is electrically insulated from each other. Gaps 119 may, for example, be laser etched after deposition of mirror layer 26.

Each phosphor 18(R), 18(G), 18(B) is shown with a distinct electrical conductor 12(R, G, B) that connects to control pins 16(PR), 16(PG) and 16(PB), respectively, allowing the electrical potential of each phosphor 18 to be independently controlled. The voltage at each phosphor 18 may thus be varied to obtain different colored light from light emitting device 500. For example, to obtain only green light, phosphor 18G is provided, via control pin 16(PG) and conductor 12(G), with an electrical potential of +10 kV and the phosphors 18R and 18B are provided with zero voltage potential, or a negative voltage of, e.g., −200V (various voltages may used here, such as those in the range of −50V to −10 kV), via control pins 16(PR), 16(PB) and conductors 12(R), 12(B), respectively. Accordingly, electrons of electron stream 802 (containing both primary and second emissions) will be attracted to phosphor 18G to generate green light, and repelled from phosphors 18R and 18B such that substantially no red and blue light is generated. A similar technique may be used to generate pure red or blue light. In another example of operation, to generate a purple light, phosphor 18B and phosphor 18R are provided with a potential of +10 kV and phosphor 18G is provided with a potential of, e.g., −200V. The blue and red light thus generated combines to generate purple light. In another example of operation, white light may be obtained from light emitting device 500 by supplying each phosphor 18G, 18R, and 18B with a potential of +10 kV; thus the red, green and blue light generated by each phosphor 18 combines to generate white light. As appreciated, other visible colors may be generated from light emitting device 500 with the appropriate combination of electrical potentials provided to phosphors 18. If each of the intensities of color for each of the three colors red, green, blue (generated by the respective phosphors 18R, 18G, and 18B) are encoded in 15-bits per color, such that each of the 15-bit color values is mapped to a corresponding voltage on the phosphor generating the color, then 36+ quadrillion colors may be generated by a multi-color light emitting device 500. If a greater number of bits (e.g., 23-bits) is used to represent distinct intensities of the colors red, green and blue generated by the phosphors 18, then a larger range of colors may be provided by the multi-color light emitting device 500. Intensity of any given color may be defined as the radiant energy of that color emitted per unit of time, per unit solid angle, and per unit of projected area of face portion 22 of light emitting device 500. Phosphor voltage seems to control the color blend of light produced by light emitting device 500.

In one embodiment, light emitting device 500 includes three cathodes, three extraction grids and three defocusing grids, where each group of cathode, extraction grid and defocusing grid operated with respect to one phosphor color. In this embodiment, internal glass separators are utilized so that three light emitting devices are encapsulated within one bulb envelope.

Since the brightness of each phosphor 18(R, G, B) (when provided with the same potential) is not necessarily equivalent (i.e., a characteristic difference between phosphor colors), the amount of light produced may be adjusted by changing the phosphor area ratio between each phosphor color. For example, under the same operating conditions, green phosphor 18(G) is brighter than red phosphor 18(R), which in turn is brighter than blue phosphor 18(B); thus to provide a balanced light output for each phosphor color, the area of blue phosphor 18(B) may be greater than the area of red phosphor 18(R) which in turn may be greater than the area of green phosphor 18(G), as shown in FIGS. 5 and 6. Thus, by constructing light emitting device 500 with the appropriate phosphor area ratios between phosphors 18, brightness control may be simplified.

Figure 7:
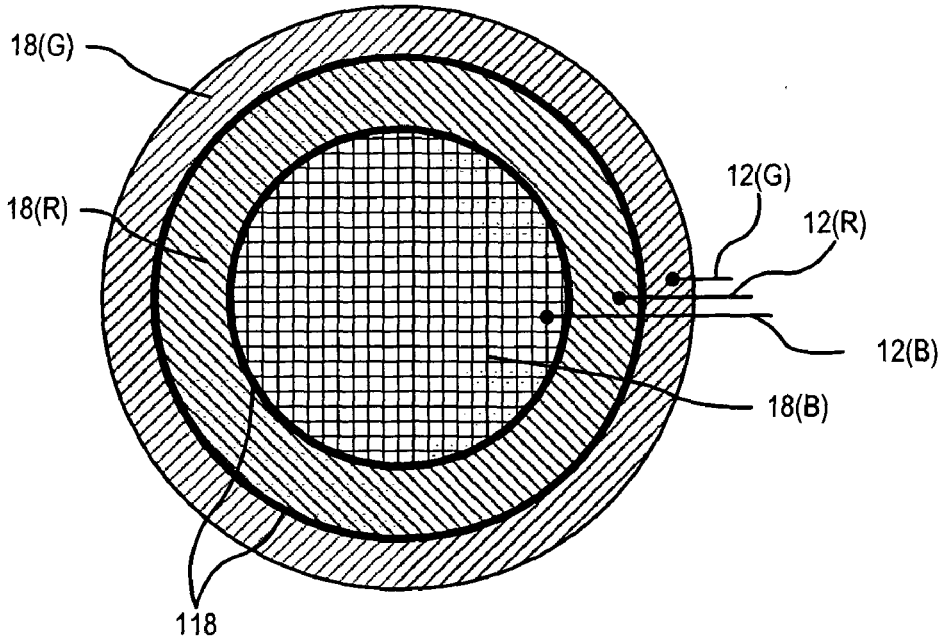
FIG. 7 shows a face-on view of one embodiment of the light emitting device of FIG. 5, illustrating an alternate phosphor layout.

FIG. 7 shows a face-on view of another exemplary embodiment of light emitting device 500 illustrating an alternate phosphor layout. The configuration of this embodiment may be advantageous in that the maximum deflection of the electron stream 802, FIG. 5, toward or away from any of the phosphors 18 is reduced when compared to the embodiments shown in FIGS. 6 and 9.

Figure 8:
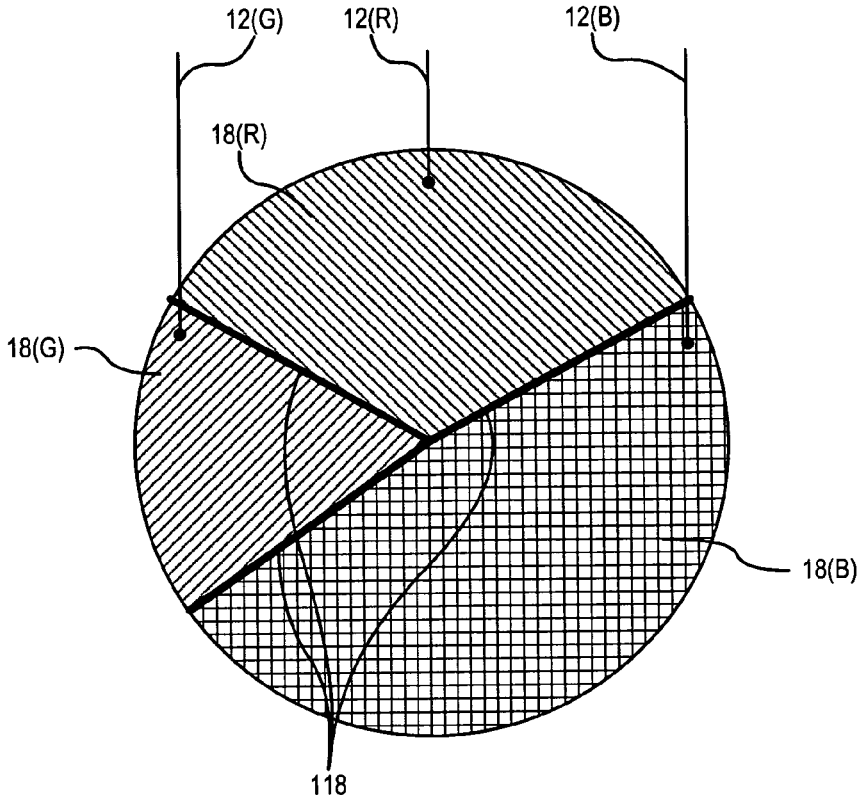
FIG. 8 shows a face-on view of one embodiment of the light emitting device of FIG. 5, illustrating an alternate phosphor layout.

FIG. 8 shows a face-on view of another exemplary embodiment of light emitting device 500 illustrating an alternate phosphor layout. As with the embodiment of FIG. 7, this embodiment may also be advantageous in that the maximum deflection of the electron stream (e.g., electron stream 802, FIG. 5) toward or away from any of the phosphors 18 is reduced in comparison to the embodiments shown in FIGS. 5 and 6.

Figure 9:
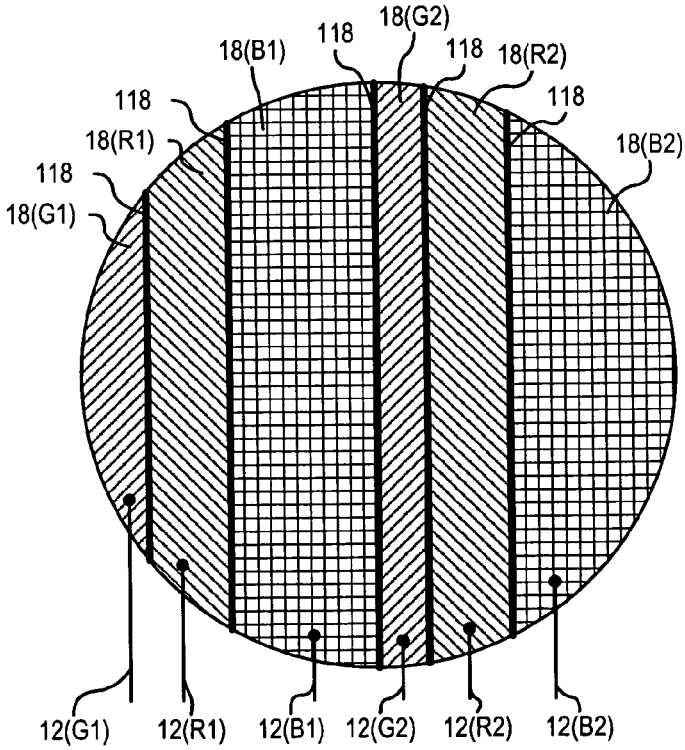
FIG. 9 shows a face-on view of one embodiment of the multi-color light emitting device of FIG. 5, illustrating an alternate phosphor layout.

FIG. 9 shows a face-on view of yet another exemplary embodiment of light emitting device 500 illustrating an alternate layout for phosphors 18. In this example, each phosphor color has two areas, which may be advantageous in that light produced by light emitting device 500 is more blended.

With reference to FIGS. 3 and 5, enclosure 14 is sealed and the interior vacuum may be from $10^{-2}$ to $10^{-8}$ Torr. If gettering is used (e.g., getter 44, FIG. 3), a non-evaporable getter (NEG) may be flashed after sealing enclosure 14. Alternatively, an evaporable getter (EG) (e.g., getter material 25, FIG. 3) may be flashed during or after the sealing of light emitting device 10, 500 to maximize sorption characteristic and to reduce vacuum processing costs of light emitting device 10, 500. Examples of such EG and NEG getter technologies are known in the manufacturing of cathode ray tubes (CRT), and vacuum fluorescent display (VFD), for example.

Figure 10:
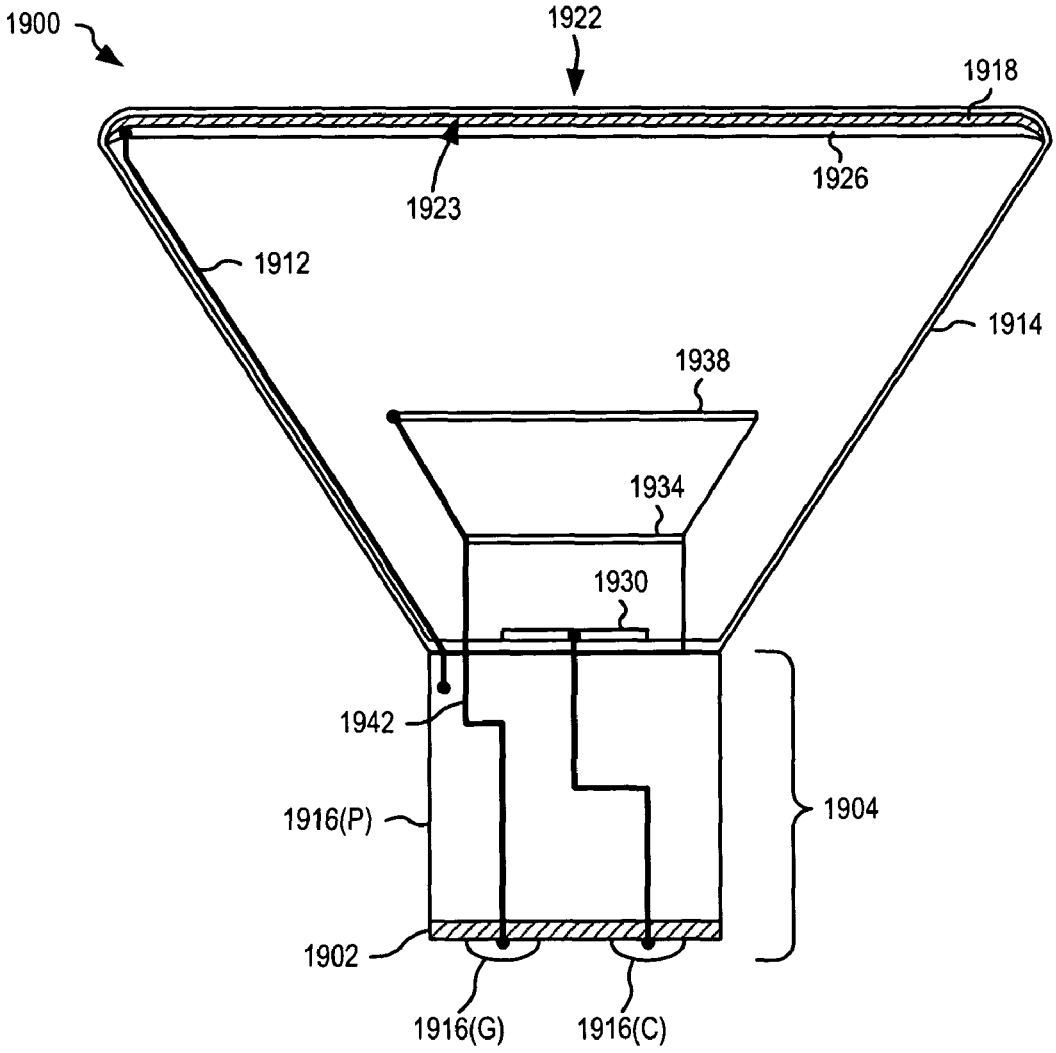
FIG. 10 shows one light emitting device constructed with three conductors, in accord with an embodiment.

FIG. 10 shows one exemplary light emitting device 1900 constructed with three connection points 1916(P), 1916(G) and 1916(C). Light emitting device 1900 may, for example, represent light emitting device 6, FIG. 2. Light emitting device 1900 has a enclosure 1914 with a face portion 1922.

The interior surface 1923 of face portion 1922 of enclosure 1914 is first coated with a phosphor 1918 and then a mirror layer 1926. Enclosure 1914 also includes a cathode 1930, an extraction grid 1934 and a defocusing grid 1938. A base section 1904 provides three electrical connection points 1916(P), 1916(G) and 1916(C) that connect phosphor 1918 (via mirror layer 1926) to grids 1934, 1938 and to cathode 1930, respectively. An insulator 1902 electrically insulates connection points 1916(P), 1916(G) and 1916(C) from each other. In the embodiment of FIG. 10, extraction grid 1934 and defocusing grid 1938 are electrically connected together by connector 1942. Connection point 1916(P) connects to phosphor 1918 (and mirror layer 1926) via connector 1912 which may be insulated to prevent electron interaction.

In an example of operation, connection point 1916(G) is connected to ground (zero volts), connection point 1916(C) is connected to a negative voltage supply (e.g., −250V) and connection point 1916(P) is connected to a positive voltage supply (e.g., +10,000V). The electric field produced between cathode 1930 and extraction grid 1934 causes electrons to be accelerated from cathode 1930, through extraction grid 1934, towards phosphor 1918. Defocusing grid 1938 does not substantially accelerate these electrons further, but does cause them to spread out, as described above. The location of electrical connections within base 1904 may be changed without departing from the scope hereof. The voltage differential between cathode 1930 and extraction grid 1934 may be varied (e.g., by varying the voltage applied to connection point 1916(C) and/or connection point 1916(G)) to modify the light intensity output from light emitting device 1900.

Figure 11:
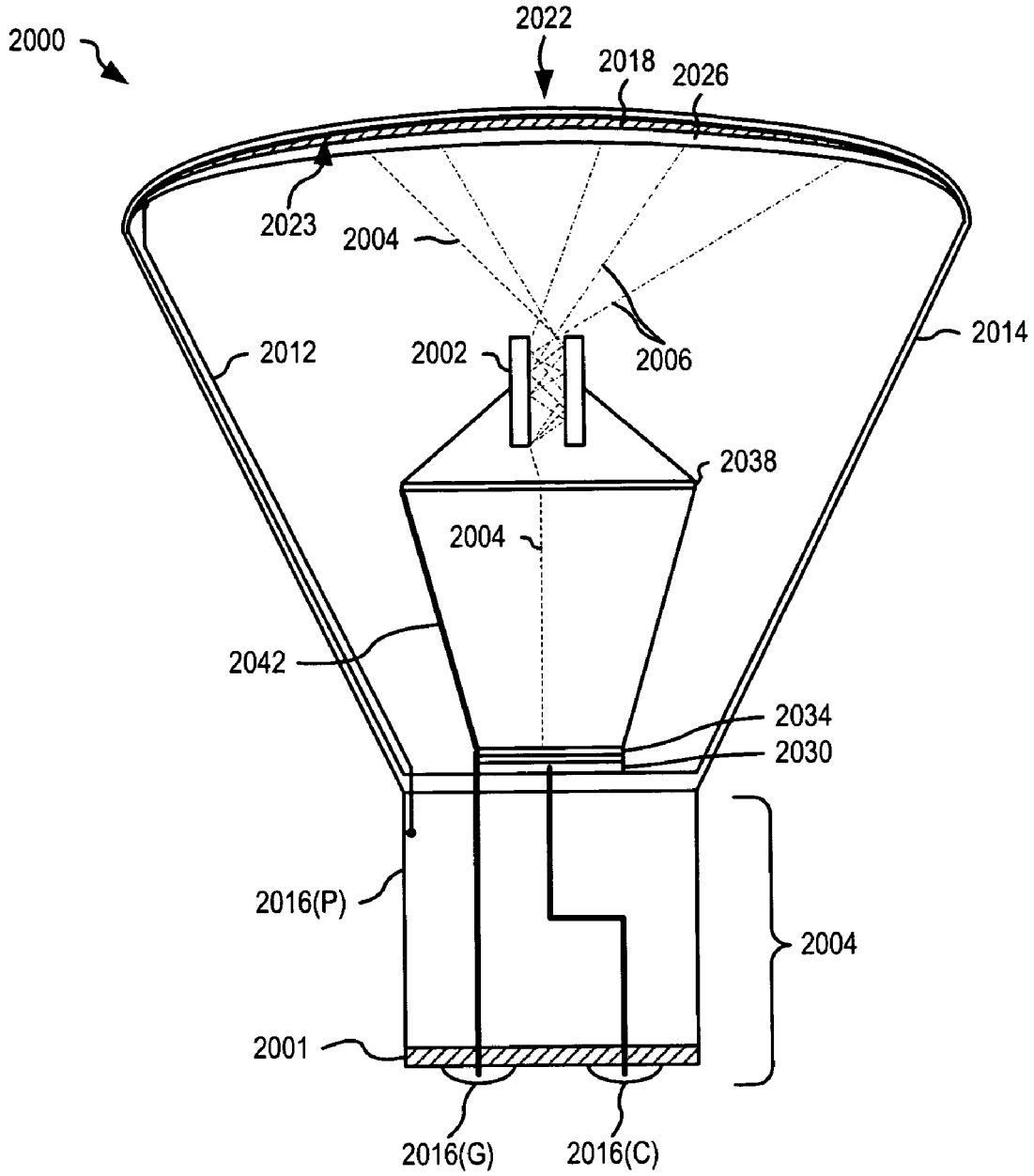
FIG. 11 shows one light emitting device constructed with three conductors, an extraction grid, a defocusing grid, a cathode and a tubulator, in accord with an embodiment

FIG. 11 shows one exemplary light emitting device 2000 constructed with three connection points 2016(P), 2016(G), 2016(C), an extraction grid 2034, a defocusing grid 2038, a cathode 2030 and a tubulator 2002. Light emitting device 2000 may, for example, represent light emitting device 6, FIG. 2. Light emitting device 2000 has an enclosure 2014 with a face portion 2022. The interior surface 2023 of face portion 2022 is first coated with a phosphor 2018 and then a mirror layer 2026. Mirror layer 2026 is, for example, aluminum. A base section 2004 provides three electrical connection points 2016(P), 2016(G) and 2016(C) that connect to phosphor 2018 (via connector 2012 and mirror layer 2026) to grids 2034, 2038 and to cathode 2030, respectively. An insulator 2001 electrically insulates connection points 2016(P), 2016(G) and 2016(C) from each other. In the embodiment of FIG. 11, extraction grid 2034 and defocusing grid 2038 are electrically connected together by connector 2042. In an example of operation, connection point 2016(G) is connected to ground (zero volts), connection point 2016(C) is connected to a negative voltage supply (e.g., −250V) and connection point 2016(P) is connected to a positive voltage supply (e.g., +10,000V). The electric field produced between cathode 2030 and extraction grid 2034 accelerates electrons from cathode 2030, through extraction grid 2034, towards phosphor 2018. Defocusing grid 2038 does not substantially accelerate these electrons further, but does cause them to spread out, as described above. Tubulator 2002 may be made of glass or other materials with an optional coating that provides secondary electron emission. Tubulator 2002 operates as an electron multiplier within light emitting device 2000. Tubulator 2002 may be cylindrical (as shown in FIG. 11), conical or formed to other shapes.

In an example of operation, an electron path from cathode 2030, through grids 2034 and 2038, tubulator 2002 and mirror layer 2026 is shown by primary electron path 2004. Extraction grid 2034 causes electrons to leave cathode 2030 and accelerate towards phosphor 2028; defocusing grid 2038 causes electron deflection as shown by primary electron path 2004. Within tubulator 2002, where the electron strikes an internal wall, secondary electron emissions occur as shown by secondary electron paths 2006. Tubulator 2002 thus operates to increase the number of electrons traveling towards phosphor 2018.

Additional tubulators may be placed adjacent to tubulator 2002, to provide additional secondary electron emission. Tubulator 2002 may be electrically neutral or have a negative charge when made from electrically conductive material. Applying a negative voltage to tubulator 2002 may prevent electrons from becoming trapped on the inside walls of tubulator 2002. The location of electrical connections within base 2004 may be changed without departing from the scope hereof.

The voltage differential between cathode 2030 and extraction grid 2034 may be varied (e.g., by varying the voltage applied to connection point 2016(C) and/or connection point 2016(G)) to modify the light intensity output from light emitting device 2000.

Figure 12:
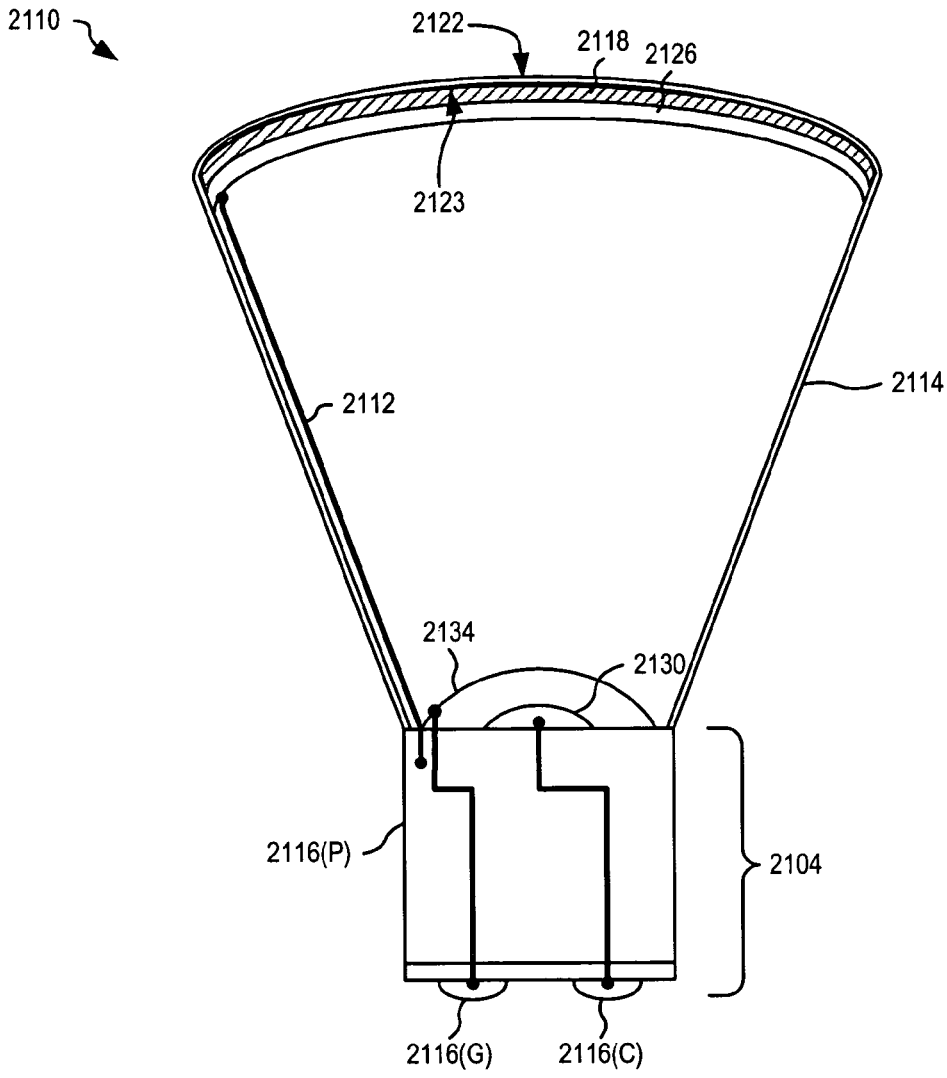
FIG. 12 shows one light emitting device constructed with three conductors, an extraction grid and a convex cathode, in accord with an embodiment.

FIG. 12 shows one exemplary light emitting device 2110 constructed with three connection points 2116(P), 2116(G), 2116(C), an extraction grid 2134 and a convex cathode 2030. Light emitting device 2110 may, for example, represent light emitting device 6, FIG. 2. Light emitting device 2110 has an enclosure 2114 with a face portion 2122. The interior surface 2123 of face portion 2122 is first coated with a phosphor 2118 and then a mirror layer 2126. Mirror layer 2126 is, for example, aluminum. A base section 2104 provides three electrical connection points 2116(P), 2116(G) and 2116(C) that connect phosphor 2118 (via connector 2112 and mirror layer 2126) to extraction grid 2134 and to cathode 2030, respectively. An insulator 2102 electrically insulates connection points 2116(P), 2116(G) and 2116(C) from each other. In the embodiment of FIG. 12, extraction grid 2134 and defocusing grid 2138 are electrically connected together by connector 2112. In an example of operation, connection point 2116(G) is connected to ground (zero volts), connection point 2116(C) is connected to a negative voltage supply (e.g., −250V) and connection point 2116(P) is connected to a positive voltage supply (e.g., +10,000V). The electric field produced between cathode 2130 and extraction grid 2134 accelerates electrons to from cathode 2130, through extraction grid 2134 and towards phosphor 2118.

Figure 13:
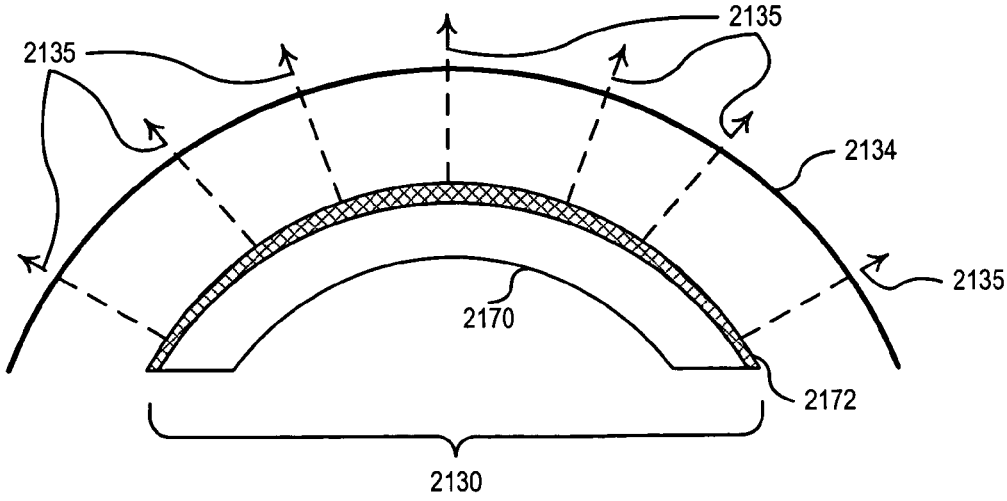
FIG. 13 shows exemplary detail the convex cathode and the extraction grid of FIG. 12.

FIG. 13 shows convex cathode 2130 and extraction grid 2134 of FIG. 12 in further exemplary detail. Cathode 2130 is shown in FIG. 13 with a substrate 2170 formed into a convex surface (e.g., a hemispherical surface), onto which is deposited an electron-emitting material 2172 having the same surface topology as substrate 2170. When the distance between electron emitting material 2172 and extraction grid 2134 is uniform, electrons emitted from electron-emitting material 2172 radiate in a direction perpendicular to the surface of electron-emitting material 2172 (as shown by electron paths 2135), thereby providing a uniform electron distribution to phosphor 2118 (without a defocusing grid). If an uneven light distribution from phosphor 2118 is desired (e.g., for a highlight beam in the center of face portion 2122), the distance between extraction grid 2134 and electron-emitting material 2172 may be varied to provide the desired electron distribution. The location of electrical connections within base 2104 may be changed without departing from the scope hereof.

The embodiment of FIGS. 12 and 13, the voltage differential between cathode 2130 and extraction grid 2134 may be varied (e.g., by varying the voltage applied to connection point 2116(C) and/or connection point 2116(G)), to modify the light intensity output from light emitting device 2110.

The embodiment of FIGS. 12 and 13 may also include other features shown in previous embodiment. For example, light emitting device 2110 may be constructed with red, green and blue phosphor areas to enable output of color light as disclosed above.

Figure 14:
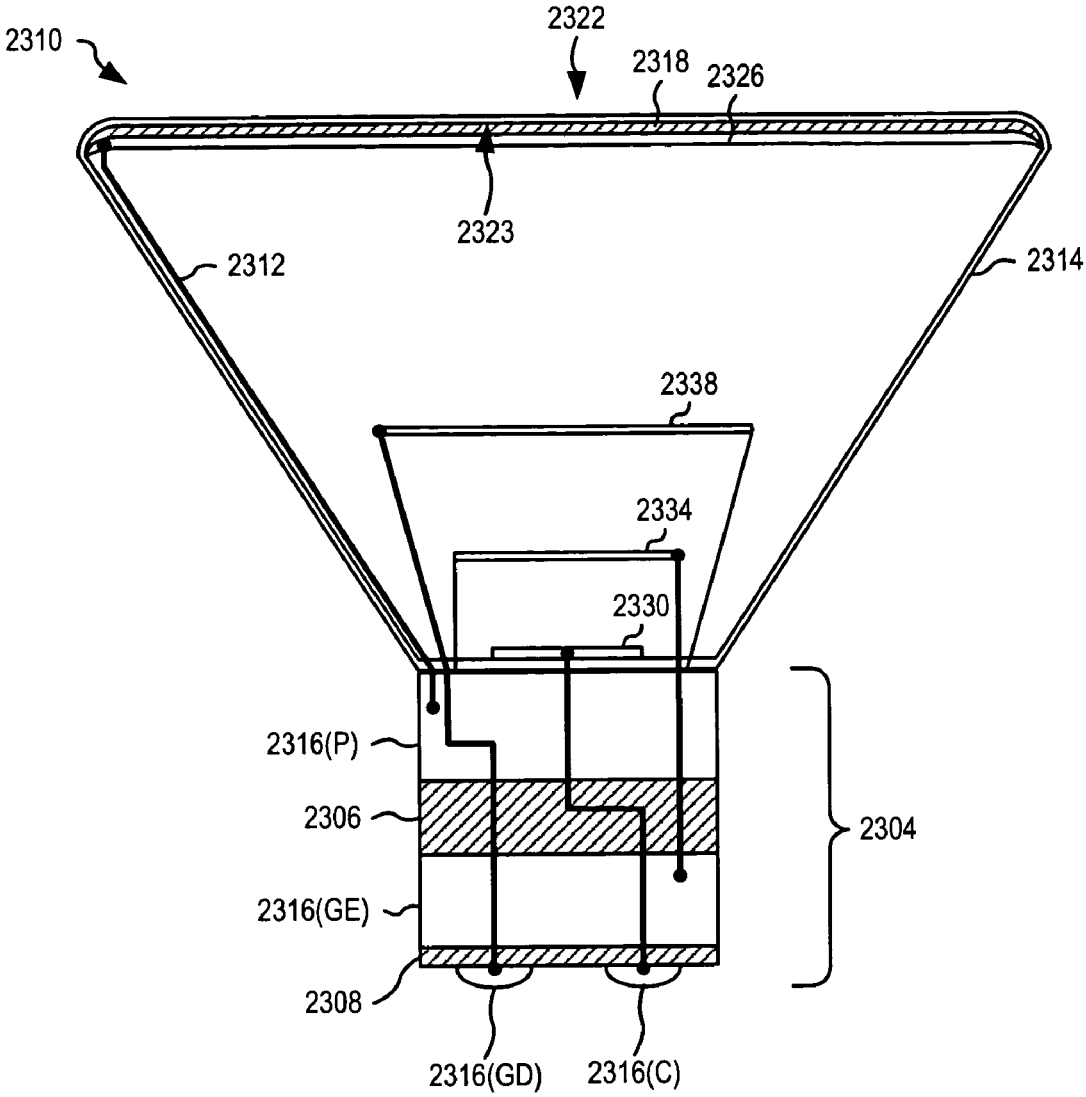
FIG. 14 shows one light emitting device constructed with four conductors, in accord with an embodiment.

FIG. 14 shows one exemplary light emitting device 2310 constructed with four connection points 2316(P), 2316(GE), 2316(GD) and 2316(C). Light emitting device 2310 may, for example, represent light emitting device 6, FIG. 2. Light emitting device 2310 has an enclosure 2314 with a face portion 2322. The interior surface 2323 of face portion 2322 is first coated with a phosphor 2318 and then a mirror layer 2326. Enclosure 2314 also includes a cathode 2330, an extraction grid 2334 and a defocusing grid 2338. A base section 2304 provides four electrical connection points 2316(P), 2316(GE), 2316(GD) and 2316(C) that connect phosphor 2318 (via mirror layer 2326) to extraction grid 2334, to defocusing grid 2338 and to cathode 2330, respectively. An insulator 2306 electrically insulates connection points 2316(P) and 2316(GE). An insulator 2308 electrically insulates connection points 2316(GE), 2316(GD) and 2316(C) from each other. Connection point 2316(P) connects to phosphor 2318 (and mirror layer 2326) via connector 2312 which may be insulated to prevent electron interaction.

In the embodiment of FIG. 14, the potential of extraction grid 2334 and defocusing grid 2338 may be independently controlled to improve and control the flow of electrons within light-emitting device 2310 (thereby controlling the intensity of light output from light emitting device 2310). The location of electrical connections within base 1904 may be changed without departing from the scope hereof.

Figure 15:
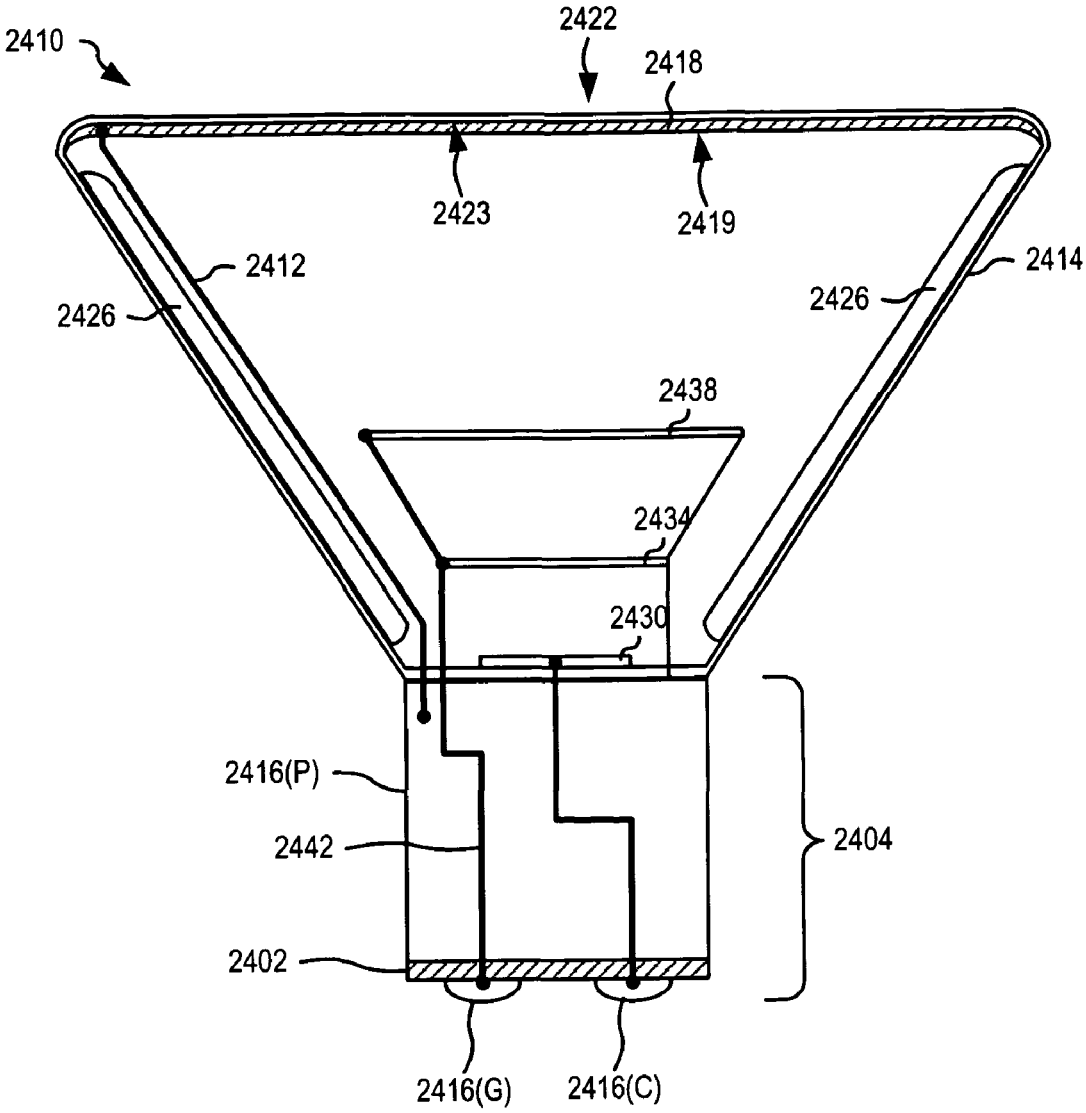
FIG. 15 shows one light emitting device constructed with three conductors, a cathode, an extracting grid, a defocusing grid and a mirror layer, in accord with an embodiment.

FIG. 15 shows one exemplary light emitting device 2410 constructed with three connection points 2416(P), 2416(G) and 2416(C), a cathode 2430, an extracting grid 2434, a defocusing grid 2438 and an alternate configuration of mirror layer 2426. Light emitting device 2410 has an enclosure 2414 with a face portion 2422. The interior surface 2423 of face portion 2422 is coated with a phosphor 2418. Side walls of enclosure 2414 are coated with a mirror layer 2426, as shown. A base section 2404 provides three electrical connection points 2416(P), 2416(G) and 2416(C) that connect to phosphor 2418, to grids 2434, 2438 and to cathode 2430, respectively. An insulator 2402 electrically insulates connection points 2416(P), 2416(G) and 2416(C) from each other. In the embodiment of FIG. 15, extraction grid 2434 and defocusing grid 2438 are electrically connected together by a conductor 2442. Connection point 2416(P) connects to phosphor 2418 via a conductor 2412, which is for example insulated to prevent electron interaction and connection to mirror layer 2426.

In the embodiment of FIG. 15, phosphor 2418 is not covered by mirror layer 2426 so that electrons with lower energy penetrate and activate phosphor 2418, thereby increasing light output of light-emitting device 2410. Mirror layer 2426 reflects light emitted from the inside surface 2419 of phosphor 2418 back towards face portion 2422. The location of electrical connections within base 2404 may change without departing from the scope hereof. The voltage differential between cathode 2430 and extraction grid 2434 may be varied (e.g., by varying the voltage applied to connection point 2416(C) and/or connection point 2416(G)) to modify the light intensity output from light emitting device 2410.

Figure 16:
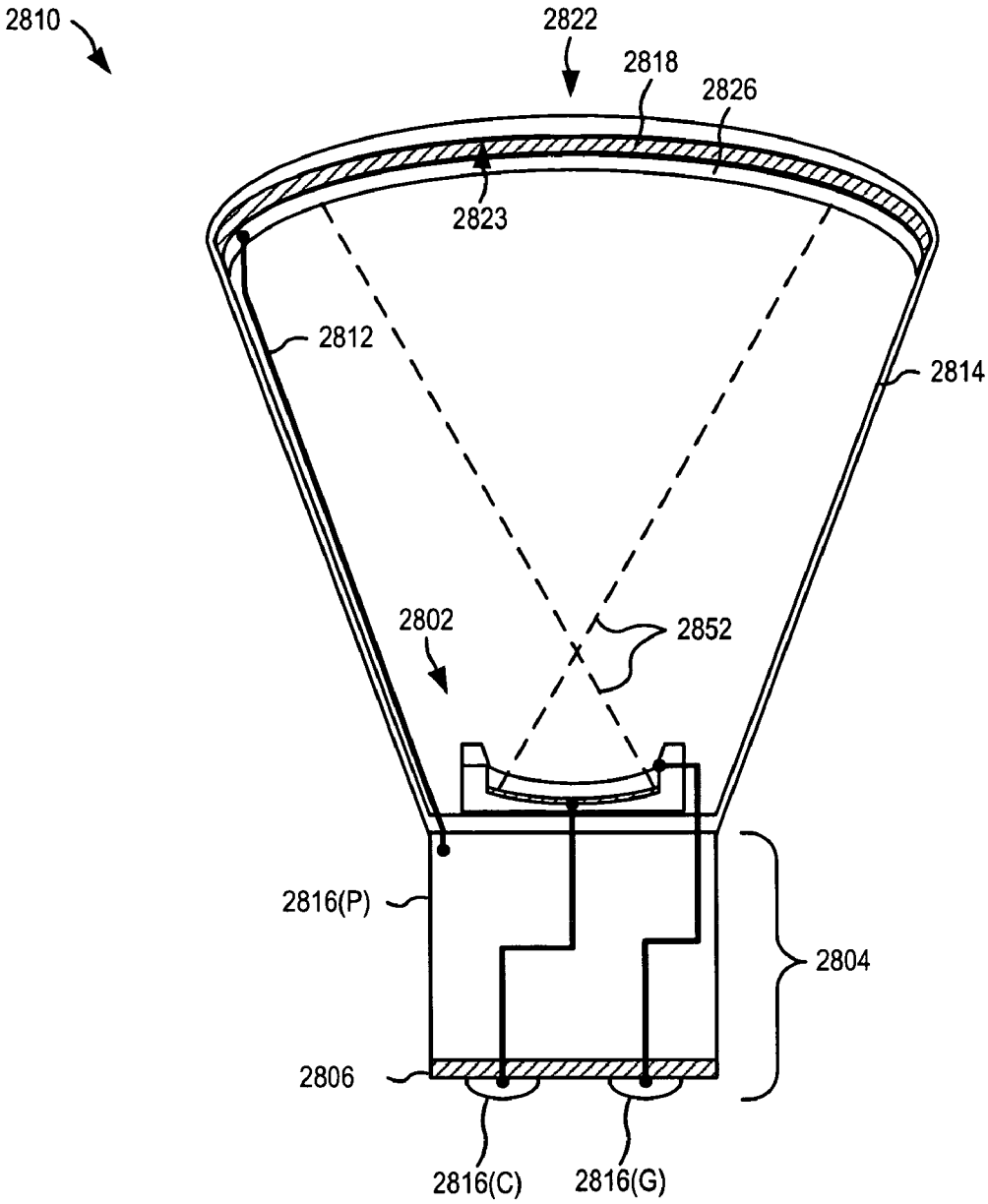
FIG. 16 shows one light emitting device with a concave cathode module, in accord with an embodiment.
Figure 17:
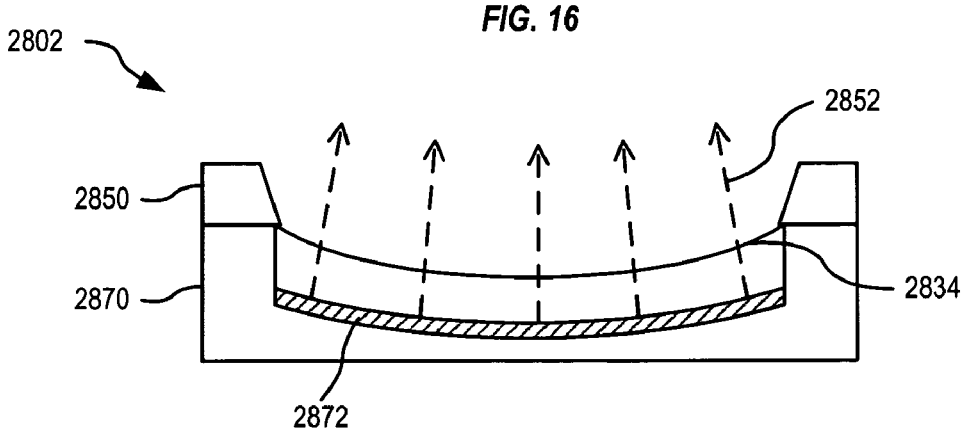
FIG. 17 shows exemplary detail of the concave cathode module of FIG. 16.

FIG. 16 shows one exemplary light emitting device 2810 with a concave cathode module 2802. Cathode module 2802 is shown in further detail in FIG. 17. FIGS. 16 and 17 are best viewed together with the following description. Light emitting device 2810 may, for example, represent light emitting device 6, FIG. 2. Cathode module 2802 has a substrate 2870, an electron emitting material 2872, a, extracting grid 2834 and a spacer 2850. Spacer 2850 is configured as part of a manufacturing process to hold extracting grid 2834 in position. Light emitting device 2810 has an enclosure 2814 with a face portion 2822 that is coated with phosphor 2818 and a mirror layer 2826, as shown. Light emitting device 2810 also has a base section 2804 that provides connection points 2816(P), 2816(C) and 2816(G) that connect to phosphor 2818, electron emitting material 2872 and extraction grid 2834, respectively. An insulator 2806 electrically insulates connection points 2816(P), 2816(C) and 2816(G) from each other. Electrons are emitted from electron emitting material 2872 and follow in a direction that is substantially perpendicular to the surface of electron emitting material 2872, as shown by electron paths 2852.

As above, the voltage differential between electron emitting material 2872 and extraction grid 2834 may be varied (e.g., by varying the voltage applied to connection point 2816(C) and/or connection point 2116(G)) to modify the light intensity output from light emitting device 2810.

The embodiment of FIGS. 16 and 17 may also include other features shown in previous embodiment. For example, light emitting device 2810 may be constructed with red, green and blue phosphor areas to enable output of color light as disclosed above.

Use of Light Emitting Devices

Light emitting devices 6, 10, 500, 1900, 2000, 2110, 2310, 2410 and 2810 may be used in various applications, systems or devices, including those described herein below. Light emitting device 6 may have an outside diameter (i.e., across face 22) in the range from 15 mm to 100 mm and a length in the range from 20 mm to 150 mm (i.e., the length being measured from face 22 to the distal end of device 10, including conductors 16; however, wire conductors 16 may extend beyond this length). In one embodiment, therefore, the size of the light emitting device 10 is 29 mm in diameter and 65 mm in length.

Large Signage or Messaging Displays

Figure 18:
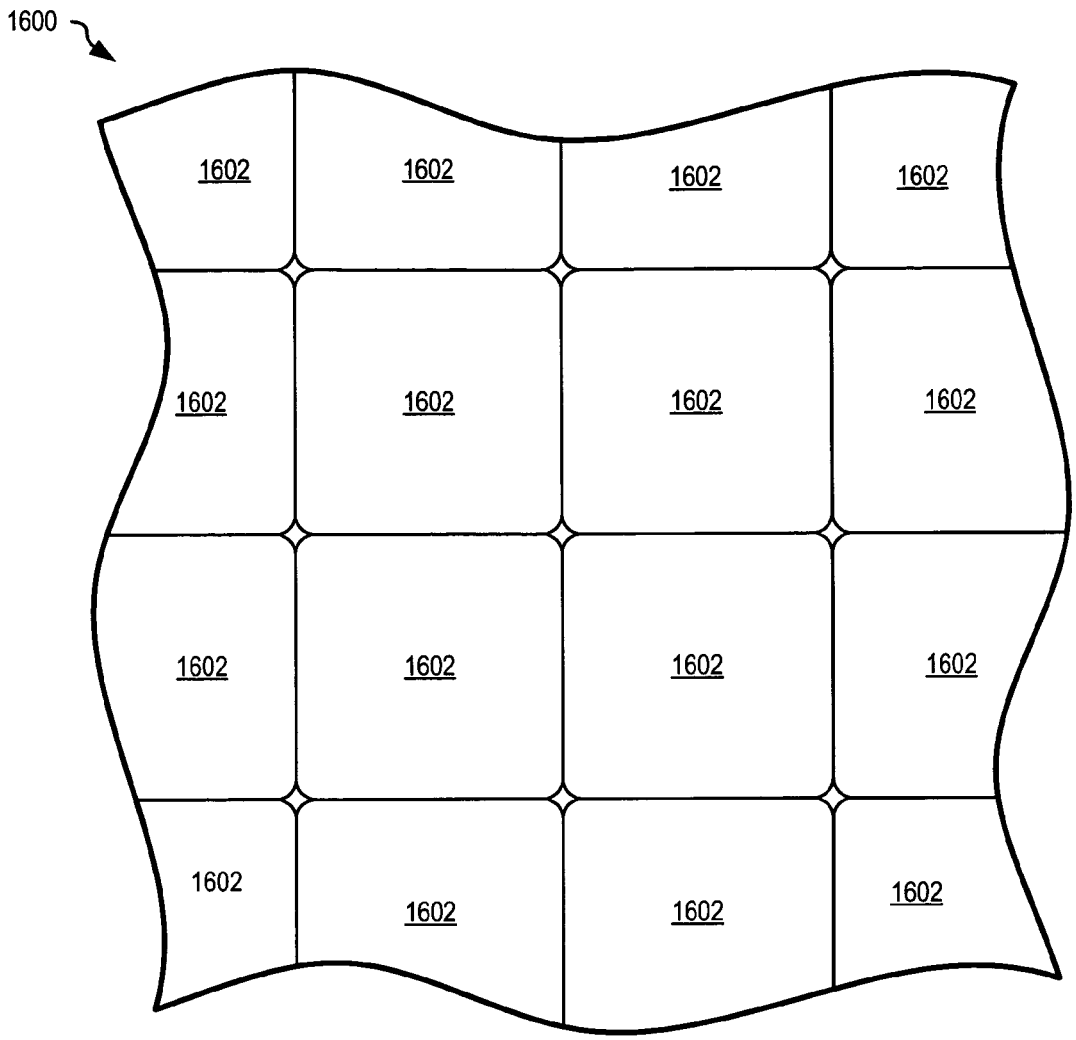
FIG. 18 shows an exemplary segment of a light emitting display with a plurality of light emitting pixels.

FIG. 18 shows one exemplary segment 1600 of a light emitting display that includes a plurality of light emitting pixels 1602. Segment 1600 may, for example, represent part of display 9, FIG. 2. Segment 1600 may, for example, be used within a billboard, an airline or train arrival/departure display of schedules, a large scale video display, etc. Each pixel 1602 may be a single color or display an entire spectrum of colors. Segment 1600 may, for example, be utilized within a billboard that displays advertisements, video clips, animation, informational signage, messages, sporting or entertainment displays, etc.

Each pixel 1602 of segment 1600 may be formed from one or more light emitting devices (e.g., light emitting device 6, FIG. 2). Note that a prior art billboard illuminated by LEDs has a brightness level in the range of approximately 5000 to 7000 nits (cd/m$^2$), and a view angle of approximately 60 to 70 degrees from the centerline of the LED. However, according to the characteristics of light emitting device 6, as described above, segment 1600 constructed with light emitting devices 6 may provide a brighter presentation with a wider view angle. Moreover, even though segment 1600 is brighter, it is likely to be safer for direct viewing than illuminated displays using, e.g., incandescent or LED light sources.

Since the blink rate of light emitting devices 6 may be greater than alternative lighting sources (e.g., incandescent, LED, and florescent), and since a full visible light spectrum range of, e.g., 36+ quadrillion colors or a full range of digital colors may be cost-effectively obtained, a light emitting display formed of light emitting devices 6 may produce high resolution color and/or gray scale images. Thus, such a light emitting display may provide better quality animated and/or motion picture presentations than heretofore has been cost-effectively possible.

Light emitting devices 6, 10, 500, 1900, 2000, 2110, 2310, 2410 and 2810 used within light emitting displays (and other similar large scale outdoor or indoor lighting) may utilize a power supply with a continuous +10 kV (DC or AC) to the phosphor 18 (or the mirror 26), and either −200V on the cathode 30, or a grounded cathode 30. The distance between the cathode 30 and the extracting grid 34 may be approximately 30 microns. The defocusing grid 38 may be similar to the extracting grid 34 except that the defocusing grid may be plated with an electron emissive plating material to enhance secondary electron emission, as described hereinabove and shown in FIG. 4. The distance between the extracting grid 34 and the defocusing grid 38 may be approximately 20 mm. The distance between the extracting grid 34 and the phosphor layer 18 may be approximately 10 mm. The power consumption for each such light emitting device 10 is approximately 0.5 W at 100% usage.

Moreover, note that for a light emitting display (e.g., a billboard) formed of light emitting devices 6, and for a given display brightness level, the consumption of electrical power by the display may be less than a comparable display formed of LED lights. This may be beneficial for large scale light emitting displays since even a small increase in efficiency per unit (e.g., light emitting device) may translate into a significant saving in power consumption due to the large number of light emitting units or sources involved.

Figure 1:
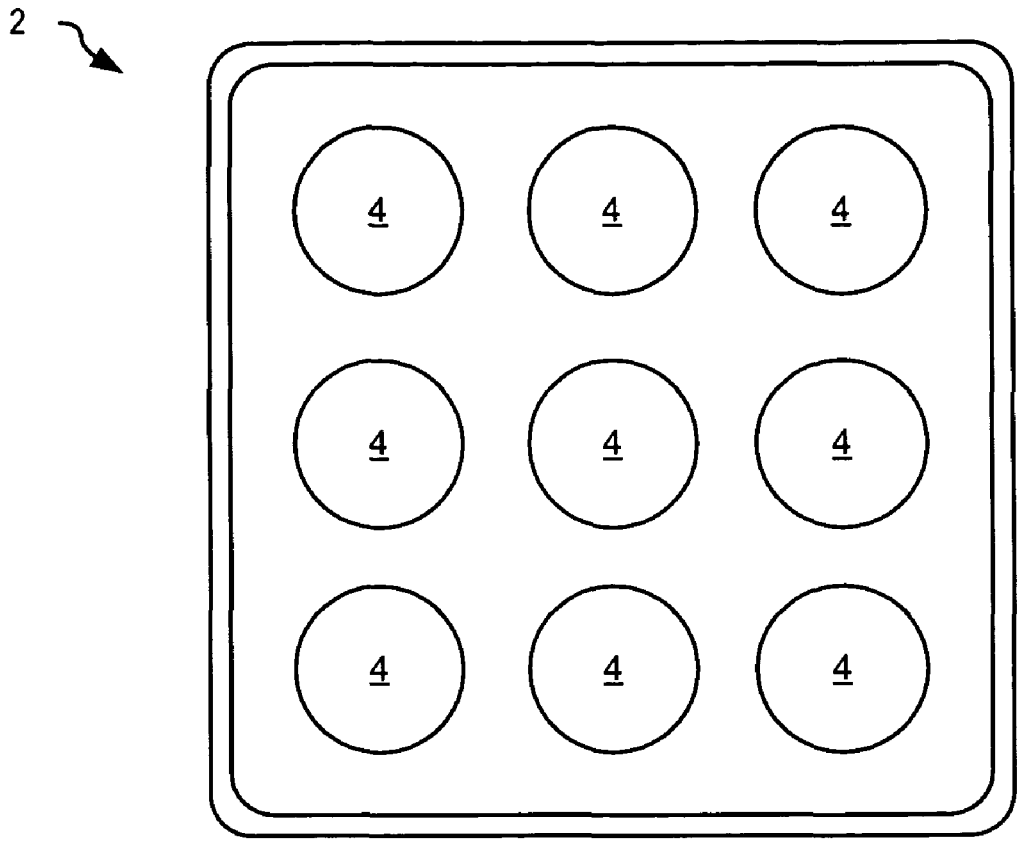
FIG. 1 PRIOR ART
FIG. 1 shows a prior art pixel with a cluster of nine individual LEDs, for a display such as a billboard.
Figure 19:
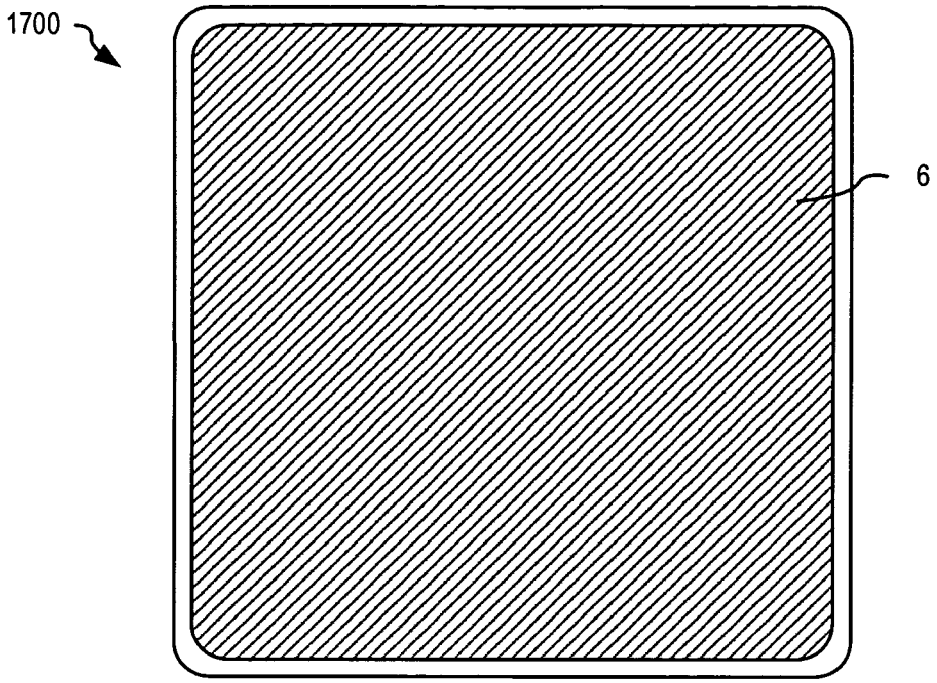
FIG. 19 illustrates an exemplary pixel with a single light-emitting device, in accord with one embodiment.
Figure 20:
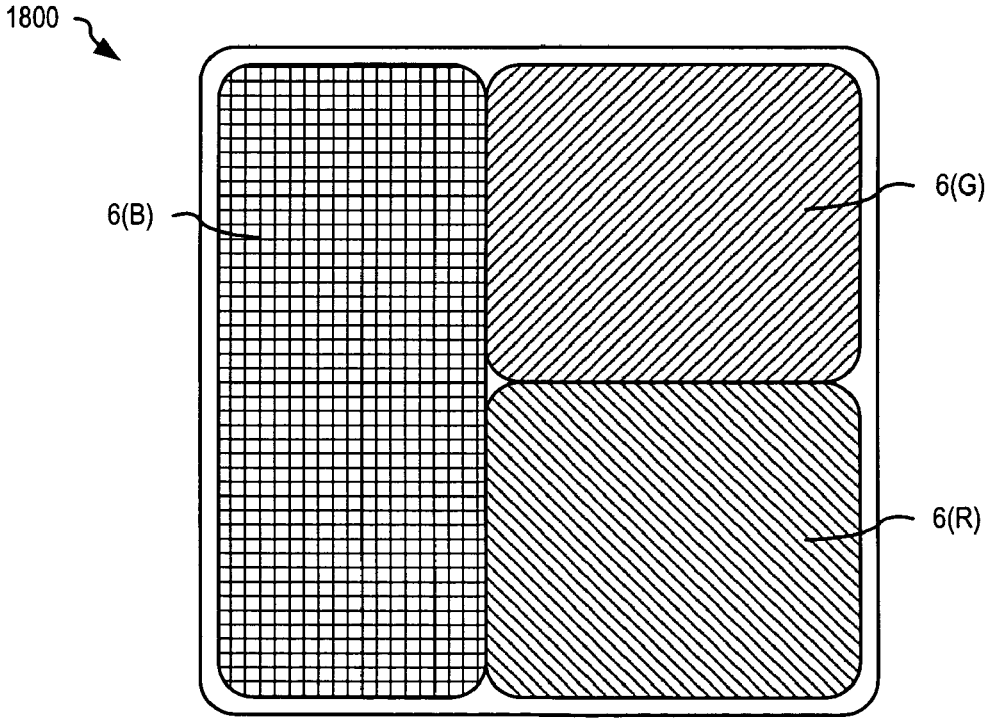
FIG. 20 illustrates a pixel with three light-emitting devices, in accord with one embodiment.

FIG. 19 and FIG. 20 show two exemplary pixel embodiments for use in a light emitting display (e.g., display 9, FIG. 2 and segment 1600, FIG. 18). In particular, FIG. 19 shows a face-on view of a pixel 1700 with one light emitting device 6, and FIG. 20 shows a face-on view of a pixel 1800 with three light emitting devices 6(R, G, B). As shown in FIGS. 19 and 20, the light emitting devices provide additional illumination area as compared to the prior art LED pixel cluster of FIG. 1. Moreover, since the light emitting devices may be readily (and cost effectively) manufactured in various shapes, an RGB color pixel using a plurality of the light emitting devices may be provided. In particular, FIG. 20 shows a single pixel 1800 with three light emitting devices 6, where each light emitting device 6 has a different color phosphor, and is labeled accordingly, i.e., R (red), G (green), and B (blue). Note that a single multi-color light emitting device 6 (as shown in FIGS. 5-9) may be used to generate 256 brightness levels of various colors, for example. In each of the pixel embodiments of FIGS. 19 and 20, light emitting devices 6 may provide greater luminous area within each pixel as compared to the corresponding prior art LED pixel of FIG. 1.

Since a prior art LED pixel that is 1.5 inches in diameter typically has six to nine LEDs therein, and requires 12 to 18 conductor attachments to power these LEDs. However, for a comparable 1.5 inch diameter pixel using a single light emitting device 6, the number of conductor attachments to the pixel is three for a single color (see, for example, the embodiments of FIGS. 3 and 5, each having three connection pins 16 since attachment to getter 44 is not used during operation). Additionally, if the 1.5 inch light emitting device 6 is a multi-color light emitting device (as shown in FIGS. 5-9), only five conductor attachments may be needed for the pixel. Thus, when a single light emitting device 6 is used as a pixel 1602, FIG. 18, the total number of electrical connectors to the electrical support circuitry of segment 1600 may be reduced. As the pixel size becomes larger (and there are correspondingly more LEDs per pixel in prior art devices), the comparative reduction in connectors may be even more pronounced when, e.g., correspondingly larger light emitting devices 6 are used so that there is, again, one light emitting device 6 (or a small number such as three) per pixel. Accordingly, for large scale lighting applications, such as billboards, where a large number of light sources are used (e.g., 40,000 to 70,000), the electrical support circuitry of devices 6 may be less complex and accordingly more reliable. And, since a single multi-color emitting light emitting device 6 may have an intensity adjustment for each color, wherein the color spectrum may be rich, e.g., assuming 256 levels of intensity per color (e.g., red, green, blue as described hereinabove in reference to FIG. 5), the number of different colors that may be emitted from a single light emitting device 6 is approximately 16,777,216 (i.e., 256×256×256). Moreover, as described hereinabove, if the intensities of the colors red, green and blue are each described by, e.g., 15 or 23 bits, even a greater number of colors may be represented by light emitting device 6.

Since light emitting device 6 generates little heat (e.g., on the order of the amount of heat that is generated by LEDs for the same luminosity), a billboard or other outdoor light emitting display using light emitting devices 6 may be less prone to high heat failure.

Moreover, signage or advertising provided by arrays of light emitting devices 6 may be cost-effectively manufactured in a desired color, including white, and the electrical power consumed is correspondingly less than incandescent lighting (e.g., approximately 90% less than corresponding incandescent lighting).

(2) Signal Lights

Various signal lights including traffic lights utilizing LED or incandescent light emitting devices with colored lenses may be replaced with light emitting device(s) 6. The advantages of the light emitting device(s) 6 over, e.g., LEDs may include those described hereinabove. However, for traffic lights brightness, viewing angle and cost-effectiveness are particularly important. Since the light emitting devices 6 may generate less heat and use less power, they may be better at resisting environmental variations such as cold, heat, humidity, for the traffic light. In particular, light emitting devices 6 may be operable in a temperature range of −30 to +50 degrees Celsius without climate control and −50 to +100 degrees Celsius with climate control. These temperature ranges are also applicable for displays (e.g., billboards) that utilize an array of light emitting devices 6.

(3) Light Emitters

Light emitting devices 6 may be used as light emitters, e.g., to illuminate a surrounding area or environment, with high brightness. Moreover, since the light emitting devices 6 may be produced in various desired shapes, the light emitting devices may be shaped to fit the lighting application. For example, the following light emitters may benefit from using light emitting device 6: cold light emitting bulbs such as those used for fluorescent lighting applications, lighting applications requiring a precise dimming capability (e.g., photography studios, theatres, etc.), lighting applications requiring a high speed blink rate (e.g., security lights, theatre/entertainment strobe lights, lights showing activation/deactivation cycles of electronic devices, etc.), and lighting applications (e.g., security lights, street lights, etc.) requiring low electrical power consumption (e.g., less than 5 watts).

Additionally, light emitting devices 6 may be mercury free. Mercury is an undesired substance for commercial use, and will be eliminated in the future for many (if not most) consumer lighting products. This may encourage replacement of existing fluorescent lights with light emitting devices 6. Accordingly, light emitting devices 6 may be manufactured at a reduced cost over, e.g., fluorescent lighting, due to the reduction in equipment and procedures for handling and processing mercury and resulting mercury contaminated byproducts. Additionally, use of the light emitting devices 6 instead of light sources having mercury therein in public or environmentally sensitive places (e.g., clean rooms, medical related rooms such as operating rooms, enclosed spaces such as military command posts, submarines, aircraft or spacecraft), may reduce the risk of mercury poisoning due to inappropriate disposal or accidental breakage.

Figure 21:
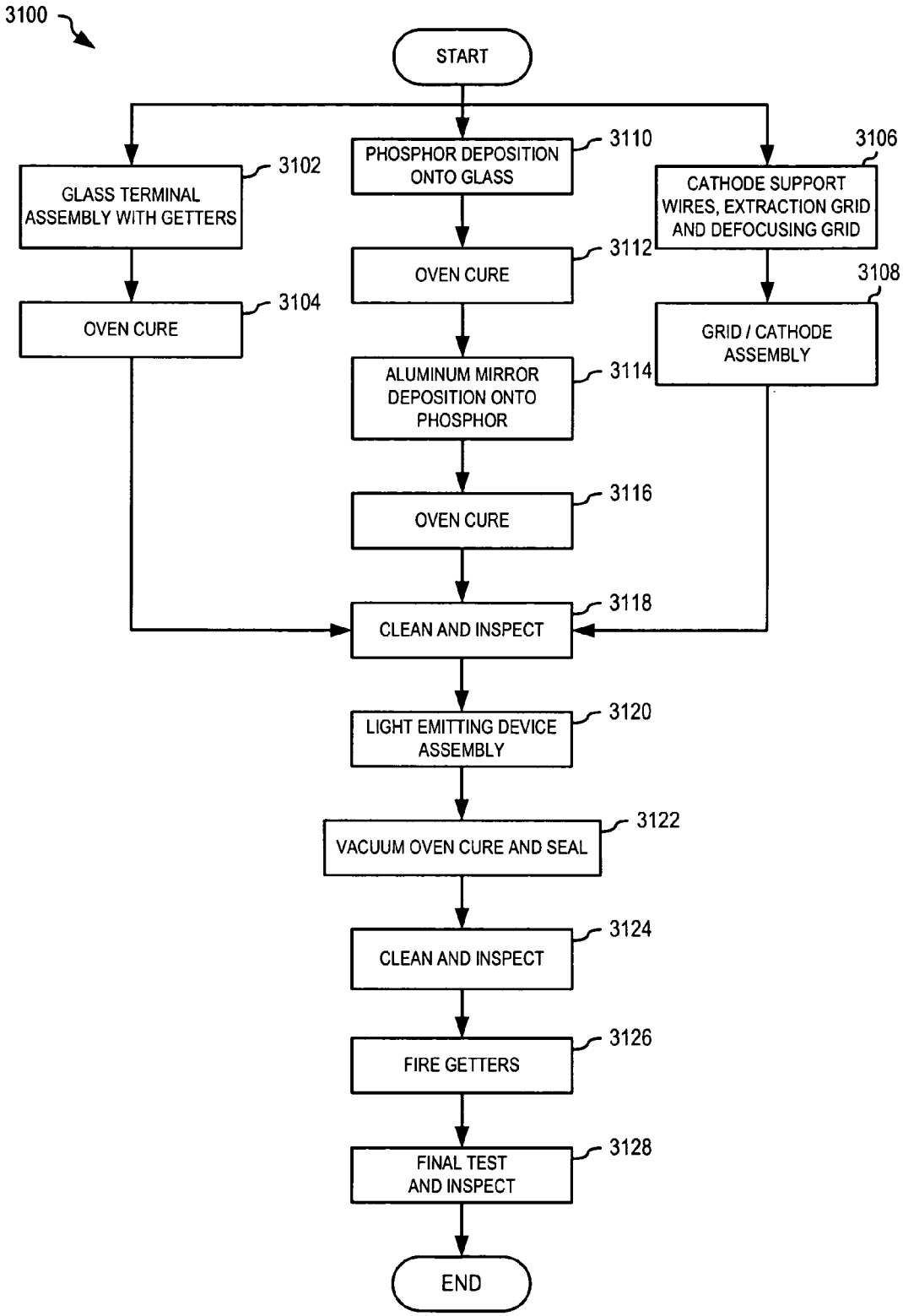
FIG. 21 is a flowchart illustrating one process for constructing a light-emitting device, in accord with an embodiment.

FIG. 21 is a flowchart illustrating one exemplary process 3100 for constructing a light-emitting device (e.g., light emitting device 6, 10, 500, 1900, 2000, 2110, 2310, 2410 and 2810).

In step 3102, the glass terminal assembly, including getters, is formed. In one example of step 3102, base section 1904, FIG. 10, if formed with connectors 1916. Optionally, getter 44, FIG. 3, is included within the formed glass terminal assembly.

In step 3104, the formed terminal assembly is cured in an oven.

In step 3106, cathode support wires, extraction grid and defocusing grid are formed. In one example of step 3106, extraction grid 1934, defocusing grid 1938 and support wires for cathode 1930 are formed.

In step 3108, the grid and cathode assembly is formed. In one example of step 3108, assembly 46, FIG. 3, is formed using results of step 3106.

In step 3110, phosphor is deposited onto glass. In one example of step 3110, phosphor 18 (FIG. 3) is deposited onto inner surface 23 of enclosure 14 corresponding to view portion 44. Where more than one phosphor is used (e.g., light emitting device 500 of FIG. 5), each phosphor is deposited in turn.

In step 3112, the phosphor is cured onto the glass in an oven.

In step 3114, aluminum is deposited onto the phosphor that was deposited in step 3110. In one example of step 3114, aluminum is deposited onto phosphor 18 (FIG. 3) to form mirror layer 26.

In step 3116, the glass, the deposited and cured phosphor and the deposited aluminum are cured in an oven.

Note, steps 3102, 3104, steps 3106, 3108, and steps 3110, 3112, 3114, 3116 may be performed in parallel. Results of steps 3102, 3104, steps 3106, 3108, and steps 3110, 3112, 3114, 3116 are them combined in steps 3118 and 3120.

In step 3118, each assembly resulting from steps 3102, 3104, steps 3106, 3108, and steps 3110, 3112, 3114, 3116 is inspected and cleaned.

In step 3120, the light emitting device is assembled from the assemblies of steps 3102, 3104, steps 3106, 3108, and steps 3110, 3112, 3114, 3116. In one example of step 3120, light emitting device 1900 is assembled with enclosure 1914 (containing phosphor 1918, mirror layer 1926, cathode 1930, grids 1934 and 1938 and connecting wires 1912 and 1942) and base section 1904 (having connection points 1916).

In step 3122, the light emitting device assembled in step 3120 is cured and sealed within a vacuum oven.

In step 3124, the light emitting device is cleaned and inspected.

In step 3126, getters within the light emitting device are fired. In one example of step 3126, getter 44 within light emitting device 10 is fired to increase the vacuum within enclosure 14.

In step 3128, the light emitting device has a final test and inspection. If these tests and inspections are passed, the light emitting device is ready for use.

Figure 22:
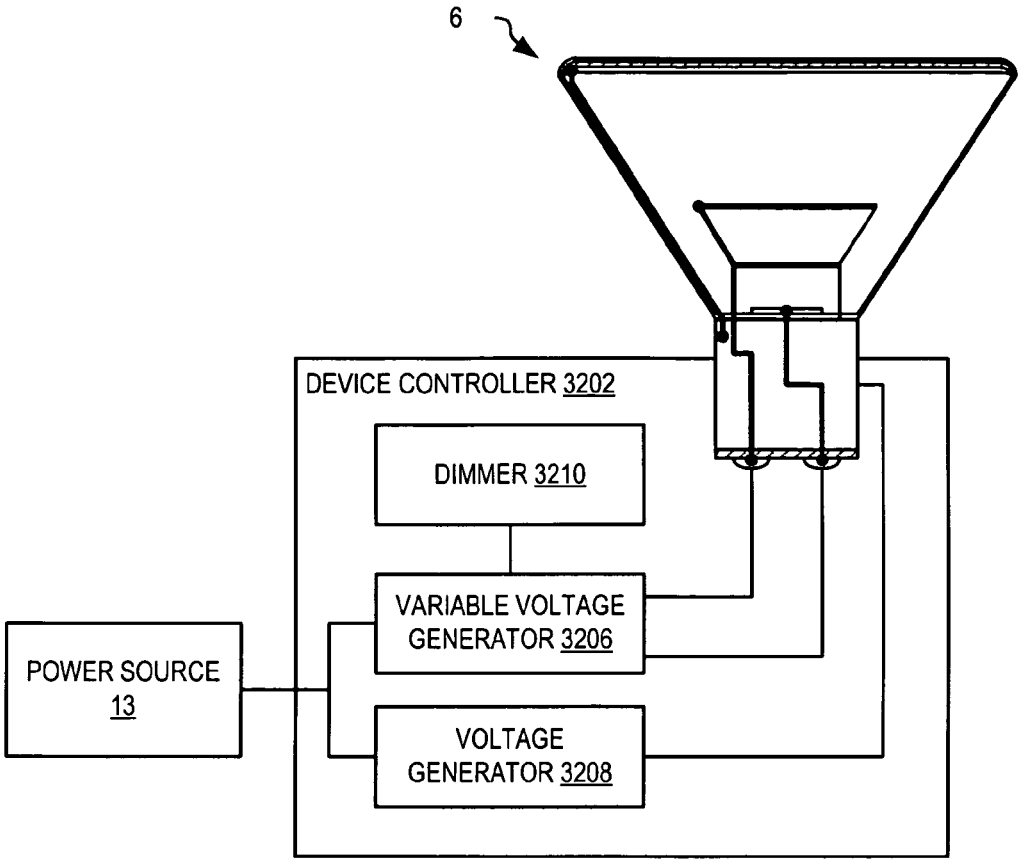
FIG. 22 shows one exemplary device controller for powering the light emitting device of FIG. 10, in accord with one embodiment.

FIG. 22 shows one exemplary device controller 3202 for powering light emitting device 6. Device controller 3202 may, for example, represent device controller 15, FIG. 2. An external power source 13 (e.g., a battery or household electricity outlet) provides power to device controller 3202. Controller 3202 has a variable voltage generator 3206 that is controlled by a dimmer 3210 to adjust voltage potential difference between the cathode and extraction grid of light emitting device 6. A voltage generator 3208 receives power from power source 3204 and produces a voltage for the mirror layer (e.g., mirror layer 1926, FIG. 10) and/or the phosphor (e.g., phosphor 1918) of light emitting device 6. Dimmer 3210 may, for example, be a digitally controller device. In one embodiment, device controller 3202 may be incorporated within the base area (e.g., base area 1904). In another embodiment, multiple light emitting devices may be incorporated into one fixture such that power supplies and dimming functions are shared, thereby providing cost savings for the fixture as compared to individual light emitting devices.

Test Configuration

Figure 23:
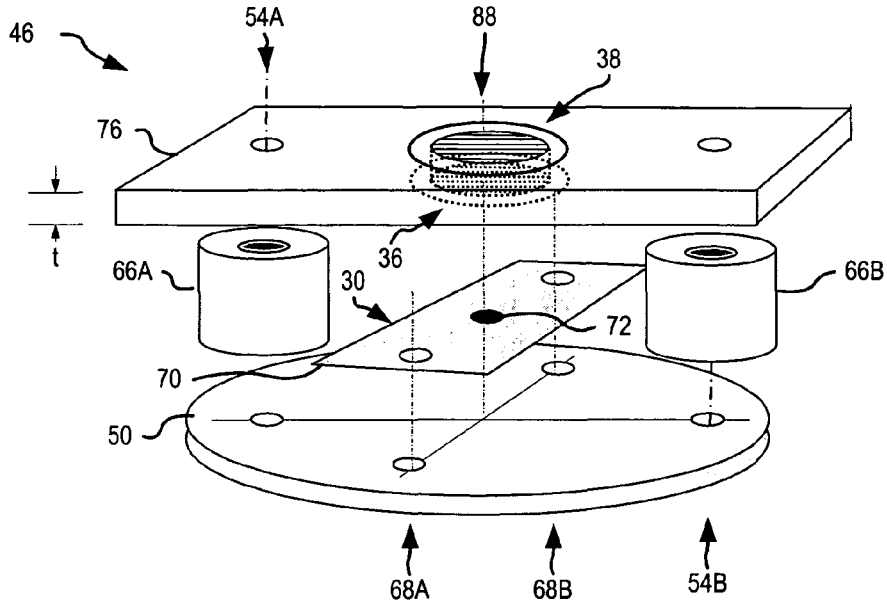
FIGS. 23 and 24 show exemplary subassembly construction including a cold cathode, an extraction grid and a defocusing grid, in accord with one embodiment.
Figure 24:
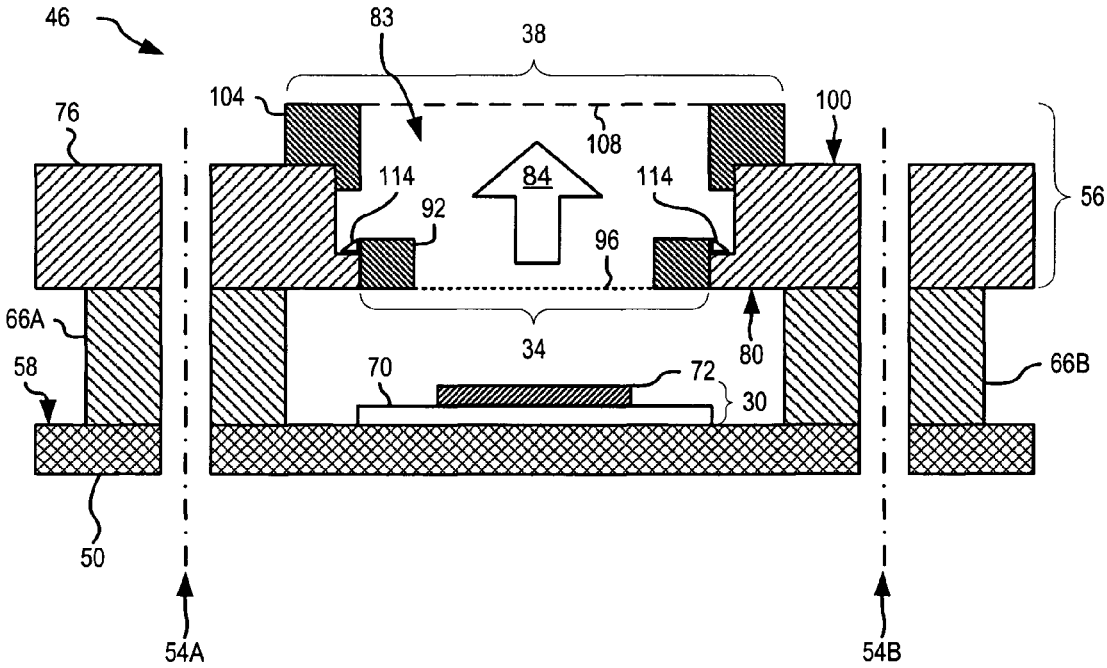

To facilitate construction of the light emitting devices described herein, cold cathodes and grids may be formed as an assembly 46 as illustrated FIGS. 23 and 24; assembly 46 was used to test light emitting device 10. FIGS. 23 and 24 are best viewed together with the following description. Assembly 46 is built prior to inclusion within the enclosure of the light emitting device. Assembly 46 has a ceramic base 50 with holes for receiving stainless steel fasteners (e.g., screws (not shown)) that attach ceramic base 50 to both cathode 30 and a grid subassembly 56 (having grids 34, 38 on opposite sides thereof). Cathode 30 is secured directly to a surface 58 of ceramic base 50 using fasteners extending through holes 68A and 68B. Two additional fasteners secure grid subassembly 56 to ceramic base 50 using holes 54A and 54B and ceramic spacers 66A and 66B. In the embodiment of FIGS. 23 and 24, cathode 30 includes a rigid rectangular substrate 70 (having the holes 68A and 68B therein) which may be made of, e.g., ceramic or nickel (or an alloy thereof), and an electron-emitting material 72 deposited in the center of substrate 70. Note that ceramic spacers 66A and 66A provide accurate spacing between cathode 30 and grid subassembly 56 (and more particularly between electron-emitting material 72 and extracting grid 34). However, in an alternative embodiment, ceramic base 50, cathode 30, spacers 66 and grid assembly 56 may be glued to together; the glue serving as a replacement for the fasteners.

Electron-emitting material 72 may be deposited on substrate 70 according to, e.g., one of the methods disclosed in U.S. Pat. No. 6,593,683 filed Mar. 7, 2001 (the '683 Patent), which is incorporated herein by reference. The '683 Patent discloses depositing a carbon film (e.g., the electron-emitting material 72) on a substrate (e.g., the substrate 70) wherein the carbon film includes a structure of irregularly located carbon micro- and nano-ridges and/or micro- and nano-threads (tips) orthogonally oriented relative to the substrate surface. The threads may have a typical size (i.e., a length in a direction away from substrate 70) of 0.01 to 1 microns and a distribution density of 0.1 to 10 $\mu m^{-2}$. The '683 Patent discloses that electron-emitting material 72 may be produced by two methods. In a first method, the electron-emitting material 72 may be produced in a DC glow discharge in a mixture of hydrogen and carbon containing gas via deposition of a carbon film on substrate 70 placed on an anode. The DC glow discharge is ignited at a current density of 0.15 to 0.5 $A/cm^2$, and deposition is carried out from a mixture of hydrogen and ethyl alcohol vapor or methane at a total pressure of 50 to 300 Torr and substrate temperature of 600 to 900 C. The concentration of ethyl alcohol during the deposition is 10% to 15%, and the concentration of methane is 15% to 30%. In the second method disclosed in the '683 Patent, electron-emitting material 72 is produced in a microwave discharge with input power of 5 to 50 W/cm$^3$ in a mixture of carbon dioxide and methane with a ratio of 0.8 to 1.2 at a pressure of 20 to 100 Torr. The deposition of the carbon on a substrate is carried out at the substrate temperature of 500 to 700 C.

Techniques for producing cathode 30 are disclosed in the following patents and patent applications, each of which is fully incorporated herein by reference:

U.S. Pat. No. 5,646,474 entitled "Boron Nitride Cold Cathode", filed Mar. 27, 1995; and U.S. Pat. No. 6,388,366 entitled "Carbon Nitride Cold Cathode", filed May 8, 1995.

WO9944215A1 entitled "FIELD EMITTER AND METHOD FOR PRODUCING THE SAME", filed Feb. 27, 1998;

WO0040508A1 entitled "NANOSTRUCTURED FILM-TYPE CARBON MATERIAL AND METHOD FOR PRODUCING THE SAME", filed Dec. 30, 1998; and WO03088308A1 entitled "CATHODOLUMINESCENT LIGHT SOURCE", filed Apr. 17, 2002.

Although carbon nano-tubes may work as electron emitting material 72, their structure is fragile and may break down under strong electrical fields, causing electrical shorting within, and thus failure of, the light emitting device. Carbon nano-tubes may nonetheless be encapsulated within a conductive polymer material to reduce failure of the nano-tubes under strong electrical fields.

But electron-emitting material 72 may be formed of carbon crystal (e.g., diamond) that is deposited onto substrate 70 by CVD. Strict control of the CVD process may be used to prevent formation of nano-tubes and/or hair-like formations upon substrate 70, since these nano-tubes and/or hair-like formations may cause shorting between electron-emitting material 72 and extraction grid 34.

Electron-emitting material 72 may have a surface area of approximately 4 mm$^2$, though it may range from 0.3 mm$^2$ to 144 mm$^2$ depending on the embodiment or application of light emitting device 10.

Assembly 46 may be provided cost-effectively within wide range of light emitting device 10 shapes, e.g., the face-on shape of the light emitting device 10 may be square, rectangular, circular, triangular, oblong, annular, or elliptical in shape. Moreover, the difference in manufacturing costs for such differently shaped light emitting devices 10 is small. Note that this is, in general, not true for LEDs; a large LED (e.g., a 0.5 inch face-on extent) having a face-on shape other than a circle and even distribution of the light, may have a manufacturing cost increase of 50% or more in comparison to a circular shaped face-on LED.

Grid subassembly 56 of assembly 46 includes a ceramic rectangular plate 76 (having the holes 54A and 54B therethrough), wherein the extracting grid 34 is attached to the side 80 (of the plate 76) which is parallel to and nearest to the cathode 30, and the defocusing grid is attached to the side 100 of the plate 76. The thickness "t" of the plate 76 may be approximately 20 mm. Note, however, in an alternative embodiment, instead of a single plate 76, there may be two relatively thin (e.g., 0.5 to 0.75 mm in thickness) parallel plates with spacers of approximately 20 mm therebetween to create the same spacing between the grids 34 and 38 as the plate 76 provides. In particular, the extracting grid 34 is attached to one of these thin plates, and the defocusing grid 38 is attached to the other of these thin plates. By using two thin plates instead of plate 76, the mass of the grid assembly 56 is reduced, and such a reduction may enhance the reliability of light emitting device 10 in environments where vibrations and/or jarring are likely.

However, regardless of how the extracting grid 34 and defocusing grid 38 are spaced apart, the separation distance between the extracting grid and defocusing grid may be in the range of 10 to 30 mm.

Grid assembly 56 forms an opening 83 for a central electron emission channel 84 extending through the thickness "t" of the plate 76, wherein this opening 83 has a center axis 88 in line with the center of electron-emitting material 72. Extracting grid 34 includes a molybdenum washer 92 with a molybdenum wire mesh 96 provided across the opening 83 of the washer and welded (e.g., fused) thereto. The pitch (i.e., spacing between wires) of wire mesh 96 is approximately thirty-two micrometers. The thickness of the washer 92 (in the direction toward the cathode 30) is approximately three hundred twenty five micrometers. The outside diameter of the washer 92 is approximately 6.5 mm and the inside diameter is approximately 3.4 mm. Note that the two round ceramic spacers 66A and 66B mentioned above accurately space the extracting grid 34 from the cold cathode 30 by, e.g., a distance of approximately 30 microns (although the distance may be in a range of approximately 20 microns to 60 microns depending on the voltage differential between the electron-emitting material 72 and the extracting grid 34). In the embodiment shown in FIG. 33, the wire mesh 96 is a parallel arrangement of wires; however, other arrangements may be provided, including two parallel arrangements at ninety degrees to one another. Materials other than molybdenum may be used for the extracting grid, such as wolfram (i.e., tungsten or a tungsten composite), titanium, stainless steel, etc.

As described above, defocusing grid 38 may be attached to the side 100 of the plate 76. Defocusing grid 38 includes a washer 104 similar to washer 92. Defocusing grid 38 also includes a wire mesh 108 provided across the interior diameter opening of washer 104, wherein this opening is coincident with electron emission channel 84. For the wire mesh 108, the wire diameter is approximately 20 micrometers and the pitch is approximately 130 micrometers. The wire mesh 108 may be made from wolfram; however, other materials may be used such as molybdenum, titanium, stainless steel, etc. Note that one or both of the grids 34 and 38 may be welded, soldered or otherwise fused to plate 76.

In one exemplary configuration, defocusing grid 38 is spaced about ten millimeters from the mirror layer 26. As shown in FIG. 24, central emission channel 84 (through the plate 76) has:

(i) a restricted diameter opening nearest the electron-emitting material 72 such that extracting grid 34 is secured across this opening, and (ii) a more expansive opening at the opposite end of the channel 84 for positioning the defocusing grid 38 there across.

Since extracting grid 34 is positioned extremely close to electron-emitting material 72, precise positioning of extracting grid 34 relative to material 72 is used to avoid shorts and arcing between electron-emitting material 72 and extracting grid 34. Accordingly, the enlarged portion of channel 84 allows use of laser welding equipment (or other welding equipment, e.g., ultrasonic welding) to enter the channel for welding extracting grid 34 in place, resulting in weld(s) 114. Subsequently, once the extracting grid 34 is secured in place, defocusing grid 38 may also be affixed in place by, e.g., laser welding. Laser welding may be advantageous over other techniques for securing the extracting grid 34 in place since laser welding may be used with equipment that precisely aligns the extracting grid in the restricted opening 83 for channel 84. Additionally, laser welding allows precise control of the quantity and geometry of the resulting welds (weld(s) 114, FIG. 24) as compared to other welding techniques. In particular, a smaller amount of welding material may be more accurately deposited for affixing the extracting grid 34 in place. This may reduce the amount of outgassing and contamination for light emitting device 10, resulting in greater longevity and reliability. Since welds 114 face away from the electron emission-material 72, there may also be less risk of such welds 114 causing shorting or arcing to cathode 30.

Other grid and/or cathode affixing techniques may be used to secure one or more of the cathode 30, and grids 34 and 38 in a desired operable position. For example, one or more of the grids and/or the cathode may be: (a) press fitted into place, (b) secured by mating together a notch or groove with a protrusion(s) or detent(s), (c) secured by crimping into place, (d) secured by encapsulating portions thereof in a molded material (e.g., glass), and/or (e) secured by fastening (e.g., riveting, or screwing), for example.

Figure 25:
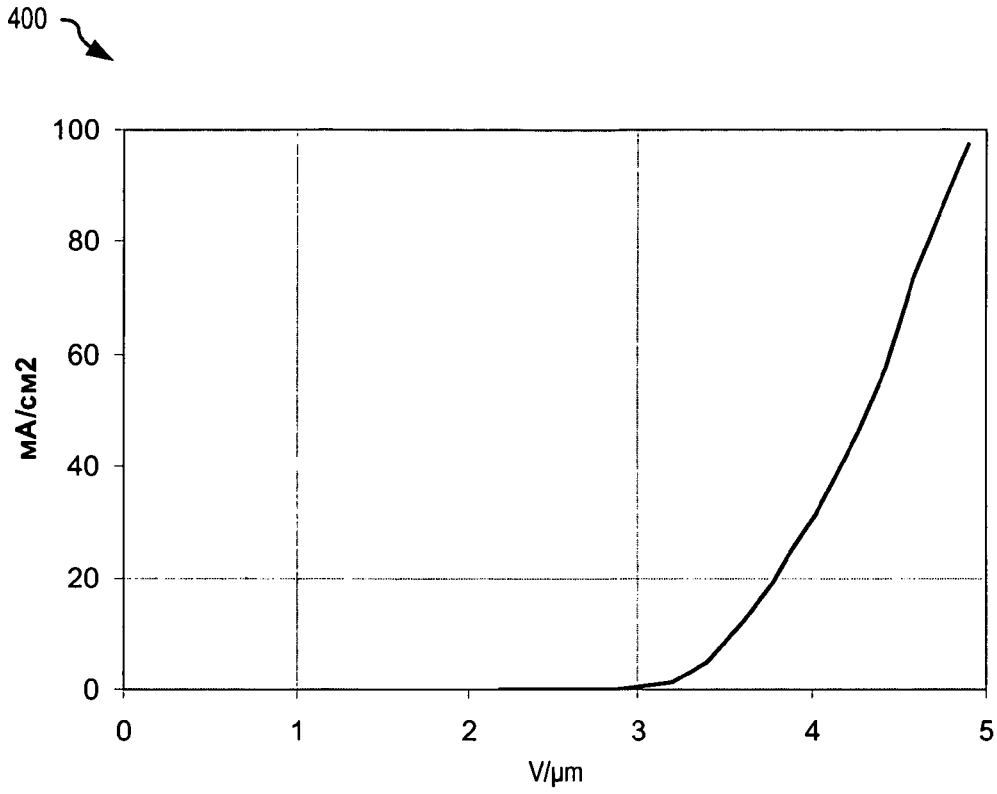
FIG. 25 is a graph showing one exemplary current to field correlation obtained from a test wherein an electron-emitting material of a cold cathode and an extracting grid are spaced apart by a distance of thirty microns.

The current to field correlation is indicated by a "U-I curve" shown in graph 400, FIG. 25; this curve was obtained from a test wherein cold cathode 30 and the extracting grid 34 were spaced apart by a distance of 30 microns. Cold cathode 30 used in this test, and in at least some embodiments of light emitting device 10, may be produced using a deposition method according to U.S. Pat. No. 6,593,683.

In one embodiment, cold cathode 30 emits electrons in a current density of 10 mA/cm$^2$. Thus, as shown by graph 400, an electric field (E) of at least 3.5 V/micron between cold cathode 30 and extracting grid 34 may be generated. Accordingly, since the electric field E may be expressed as E=V/d, where V represents the voltage at cathode 30 and d represents the distance from cathode 30 to extracting grid 34 (assuming a cathode voltage of approximately −200V), the maximum distance d=|V/E|=200/3.5=57 microns. Thus, in at least one embodiment, extracting grid 34 may be positioned approximately 30 microns from cold cathode 30. Additionally, as shown by the graph of FIG. 25, the relationship between current density and the electric field is not necessarily linear, suggesting that current and pulse-width modulation may be a better luminance or brightness regulating technique for the light emitting device 10 than modifying the strength electric field, particularly since pulse-width modulation is a faster and more accurate method of luminance regulation than regulating electric field strength. Moreover, components for pulse-width modulation are generally less expensive than components for regulating the strength of an electric field. Additionally, pulse-width modulation may be adequately implemented using an 8-bit computer, for example. However, brightness regulation may be implemented via changes to the differential voltage between cold cathode 30 and extracting grid 34 (e.g., by modifying one or more of cathode voltage and extraction grid voltage).

For an array of light emitting devices 10 having a vertical refresh rate of 100 Hz (and thus the duration being 10 ms) to achieve 256 brightness levels, the impulse duration may be an increment of 10 ms/256=40 microseconds. Therefore, brightness (B) will be proportional to the impulse duration: i.e., B=n×40 microseconds where n is a whole number from 1 to 256. Since it is less expensive to implement a digital brightness control, and such controls are more efficient than analog voltage drivers, digital brightness controls may be more cost effective for use with many (if not most) embodiments of light emitting device 10 to control brightness.

The grid wire pitch for extracting grid 34 may be the same or less than the distance between cold cathode 30 and extracting grid 34. Accordingly, a grid with a pitch of 30 microns may be used. However, a pitch in the range of 10 to 30 microns may also be used.

Electrons leaving cold cathode 30 have electron velocities related or correlated to the differential voltage between cold cathode 30 and extracting grid 34. It has been experimentally determined that operation with extracting grid 34 alone (i.e., omitting defocusing grid 38) provides an insignificant angular dispersion to the beam of electrons emitted from cold cathode 30, e.g., a dispersion of less than 3 degrees. By electrically connecting both extracting grid 34 and defocusing grid 38 together, the same electrical potential is applied to each grid, and consequently a substantially constant and relatively slow electron velocity is provided between the grids. However, when the electron beam exits from defocusing grid 38, the dispersion of the electron beam is greater, e.g., 10 to 40 degrees (measured from cold cathode 30) depending on the distance between extracting grid 34 and defocusing grid 38, assuming each grid (i.e., extraction grid 34 and defocusing grid 28) has a transparency of 66%.

Without being bound to any particular theory of operation for embodiments of the light emitting device 10, brightness of light emitting device 10 may be theoretically calculated as follows:

$$B=3.2\cdot\eta\cdot J\cdot U$$

where: B is brightness (cd/m$^2$),

η is the phosphor efficiency (Lm/W),

J is the average current density (uA/cm$^2$), and

U is the electron energy (phosphor 18 voltage) (kV).

Accordingly, assuming an average phosphor efficiency of: η=15 Lm/W, together with the above determined values for average current density, and electron energy, the average brightness for the light emitting device 10 is: B=3.2·x15x·40x·10=19,200 nits (i.e., cd/m$^2$).

In one embodiment, cold cathode 30 may be up to 100 times smaller in area than the area of phosphor layer 18 facing mirror layer 26. Such an embodiment may be provided by optimization of the current density in the range of 0.2 and 0.4 microAmperes/cm$^2$ between cathode 30 and phosphor layer 18. Note that for a clearance of 30 micrometers between cold cathode 30 and extracting grid 34, if extracting grid 34 is operating at a high current density, this high current density could have adverse effects on extracting grid 34 and cathode 30 (e.g., as excessive heating and grid deformation, current variation etc.). A test in a vacuum chamber was performed to determine whether a clearance of 30 micrometers between cold cathode 30 and extracting grid 34 (operating at a relatively high current density of 40 mA/cm$^2$) has adverse effects on the grid 34 and/or the cathode 30. A description of the test and its results follows.

Figure 26:
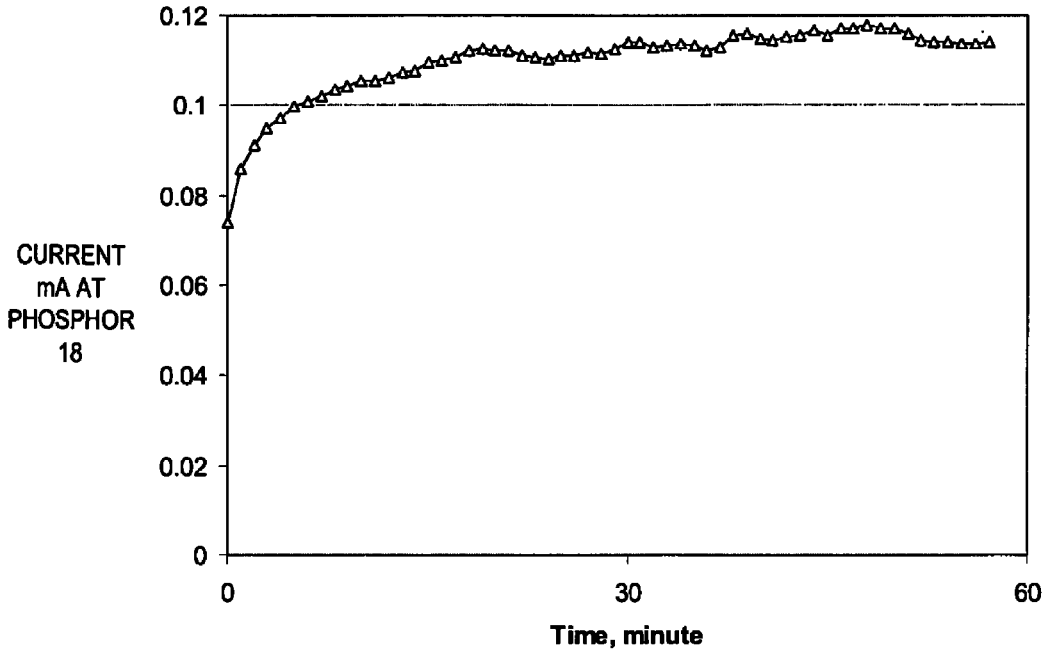
FIG. 26 is a graph illustrating stability of one cold cathode and an extracting grid over a sixty minute test.

The test was performed on light emitting device 10 components provided in a vacuum chamber; in particular, phosphor layer 18 and assembly 46 (FIGS. 23, 24) were provided in the vacuum chamber. The current (in milliamps) on phosphor layer 18 was measured over time (i.e., 60 minutes), wherein (a) the extracting grid voltage was +207V, (b) cold cathode 30 current density was 0.01 A/cm$^2$, and (c) phosphor 18 voltage was constant (and continuous) at +10 kV. FIG. 26 shows a graph illustrating stability of cold cathode 30 and extracting grid 34 over sixty minutes of the test. In particular, the graph of FIG. 26 indirectly illustrates stability of assembly 46. That is, if there were adverse effects at assembly 46 due, for example, to the high extracting grid voltage and/or current density at cathode 30, then a pronounced fluctuation in the current at phosphor 18 would be expected. However, the only fluctuation is the initial current increase at phosphor 18 (e.g., in the first approximately five minutes) which is believed to be caused by cathode 30 surface outgassing. It is believed that for the embodiment of cathode 30 used in this test, current density may be increased by a factor of 100 times without substantially affecting the electron emission stability or the longevity of cathode 30. Accordingly, by using embodiments of light emitting device 10 having electrical characteristics substantially similar to those in the above-described test, the light emitting device 10 has a particularly high safety factor while reliably providing over-all cathode stability, and with virtually no device malfunctions from, e.g., excessive heat causing grid thermal expansion (sagging and deformation) at cathode 30. However, for an embodiment of light emitting device 10 having the electrical characteristics provided in the present test, the current density at cathode 30 may be increased to 1.0 A/cm$^2$.

It is also worthwhile to mention that for the above-described test, the current density and power density at phosphor 18, were, respectively, $5\times10^{-5}$ A/cm$^2$ and 0.4 W/cm$^2$. Thus, for at least phosphor 18 current densities and power densities of approximately these values, the current at the phosphor is not adversely affected, and there are no adverse effects to the cathode 30 or the extracting grid 34.

Figure 27:
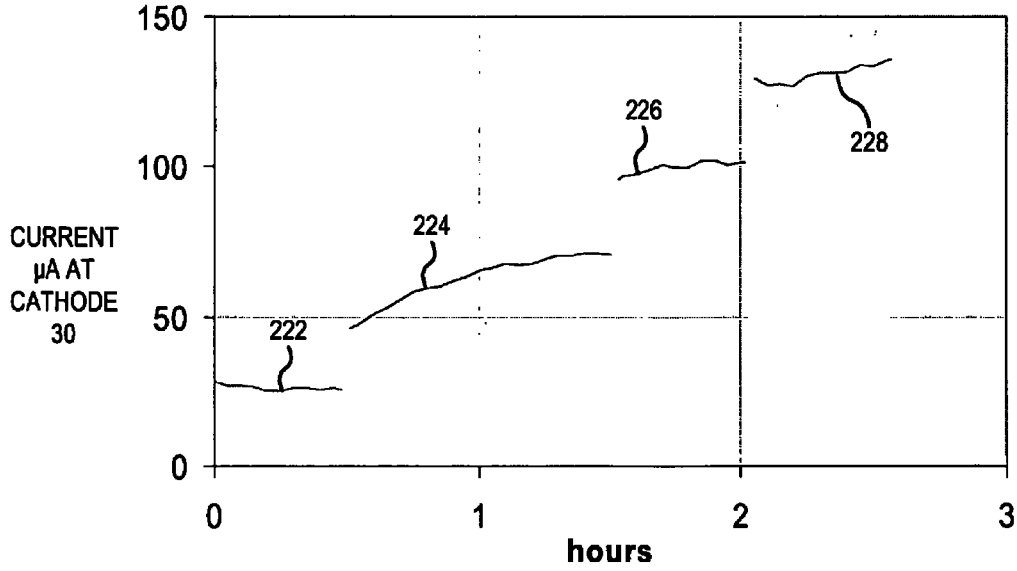
FIG. 27 illustrates current stability at a cold cathode for each of four different voltage differentials between the cathode and the extracting grid of the device of FIG. 23, 24.
Figure 28:
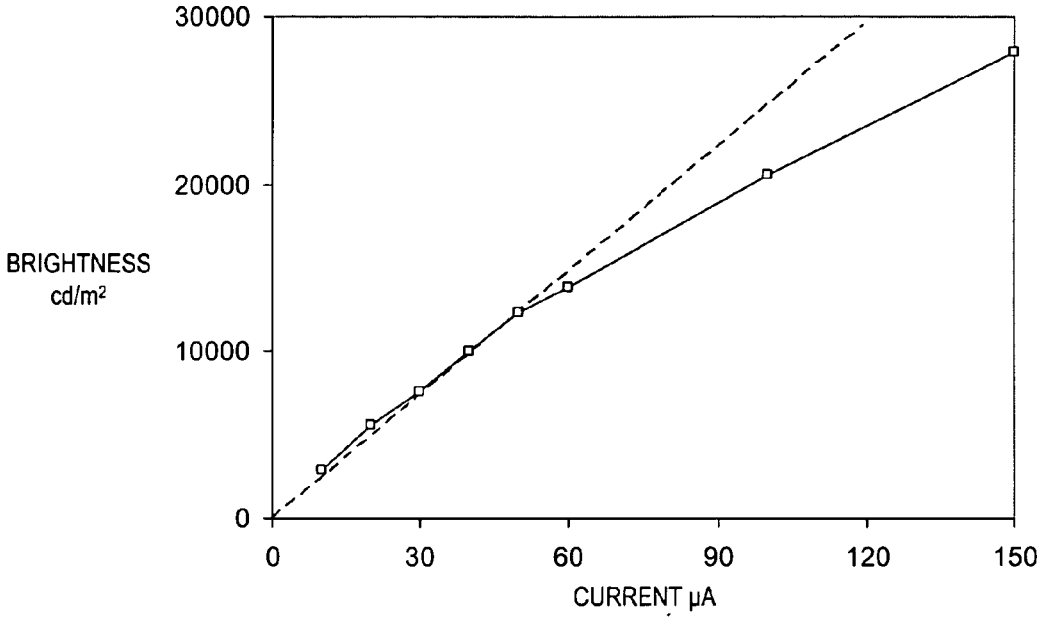
FIG. 28 shows brightness measurements for one light emitting device, measured in nits ($Cd/m^2$) versus the corresponding current at the phosphor of the device of FIG. 23, 24.
Figure 29:
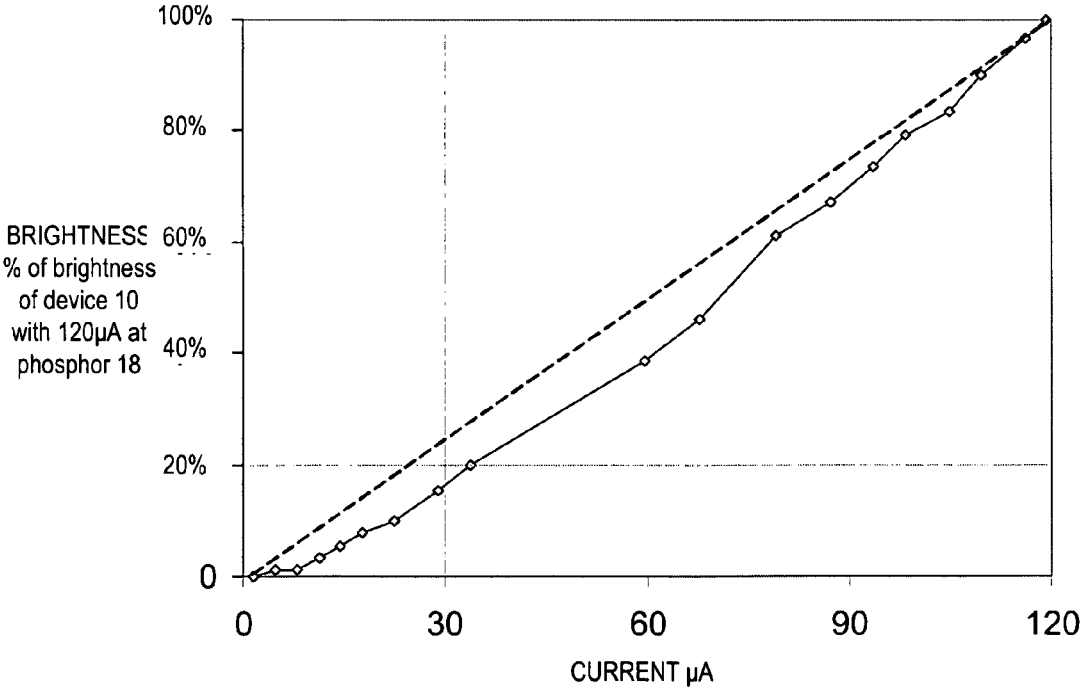
FIG. 29 illustrates relative brightness of one light emitting device for various phosphor currents, in comparison to the brightness of the light emitting device of FIG. 23, 24 with a phosphor current of 120 μA.

FIGS. 27-29 show graphs related to the electrical characteristics of one embodiment of a light emitting device 10 during operation, wherein:

- the light emitting device 10 has a phosphor 18 illumination surface of approximately 2 cm$^2$,
- the light emitting device 10 has a current at the phosphor of approximately 40 microamps (μA),
- the electrical power at the phosphor is 0.4 W (i.e., +10 kV×40 μA=0.4 W), and
- the cathode 30 current density is 100 times greater than the current density at the phosphor 18 since the surface of the electron-emitting material 72 is 100 times smaller (2 sq. mm) than the phosphor 18 surface (2 sq. cm); thus the cathode (more specifically, the electron-emitting material 72) current density is approximately 4 milliamps/cm$^2$.

In particular, FIG. 27 illustrates the stability of the current at the cathode 30 at each of four different voltage differentials, wherein the voltage measurements for each voltage differential correspond to the voltage between cathode 30 and extracting grid 34 (i.e., extracting grid voltage-cathode voltage). That is, at each voltage differential, +250, +266, +280 and +290 volts between cathode 30 and extracting grid 34 (which was grounded), the current remained stable (e.g., there were no current spikes or drop outs) as shown by lines 222, 224, 226 and 228, respectively. Thus, even for high cathode currents of 120 μA (corresponding to −290 volts, or a voltage differential of +290), this current remained stable during operation of light emitting device 10.

FIGS. 28 and 29 show additional graphs of the operational characteristics of light emitting device 10 during the test for obtaining the data of graph of FIG. 27. In particular, FIGS. 28 and 29 illustrate a correlation between brightness and current at the anode (i.e., phosphor 18) having a voltage of +10 kV. FIG. 29 shows brightness measurements for light emitting device 10, measured in nits (Cd/sq·m) versus the corresponding current at phosphor 18. In particular, FIG. 29 shows substantial linearity up to approximately 50 μA at phosphor 18. Additionally, upon providing −290V to cathode 30 (with extracting grid 34 grounded, i.e., a differential of 290 volts) for generating a current of approximately 120 μA at phosphor 18, it is expected that a light output of about 24,000 nits may be produced.

FIG. 29 shows the relative brightness of light emitting device 10 (in comparison to the brightness of the light emitting device when a current of 120 μA is provided at the phosphor 18) for various currents at phosphor 18. The vertical axis units represent percentages of brightness relative to the brightness of light emitting device 10 when 120 μA is provided at phosphor 18. Thus, 100% on the vertical axis of FIG. 29 represents approximately 24,000 nits as shown in FIG. 28.

Figure 30:
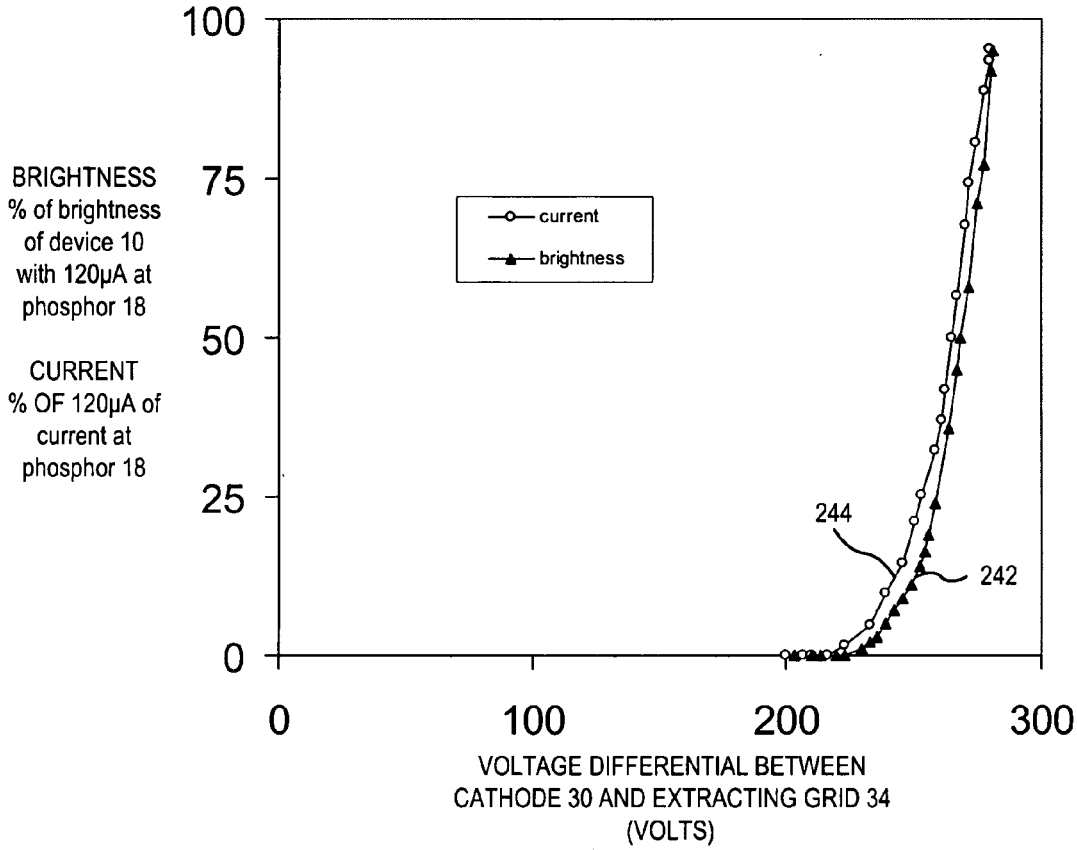
FIG. 30 is a graph illustrating brightness and current of the phosphor versus cathode voltage of the devices of FIG. 23, 24.

For a voltage of +10 kV at phosphor 18, FIG. 30 shows two graphs 242 and 244 wherein:

- graph 242 shows the relative brightness at the phosphor 18 versus the voltage tested at the cathode 30; in particular, for the graph 242, the percentages on the vertical axis represent percentages of the brightness of the light emitting device 10 operating with 120 μA at the phosphor 18 (i.e., approximately 24,000 nits), and
- graph 244 shows the relative amount of current at the phosphor layer 18 versus the voltage tested at the cathode 30; in particular, for the graph 244, the percentages on the vertical axis represent percentages of 120 μA of current at the phosphor 18.

Note that 100% of all brightness levels fell between a voltage differential of +200 to +280 volts. Thus, the voltage differential range of 80 volts (from +200 to +280) is believed to be effective for providing all 256 brightness levels resulting from 8-bit brightness control.

The foregoing discussion has been presented for purposes of illustration and description. Further, the description is not intended to be limited to the form disclosed herein. Consequently, variations and modifications commensurate with the above teachings, within the skill and knowledge of the relevant art, are within the scope of the features disclosed herein. The embodiments described hereinabove are further intended to explain the best mode presently known of practicing the light emitting device and to enable others skilled in the art to utilize the features disclosed herein as such, or in other embodiments, and with the various modifications required by their particular application or use. It is intended that the appended claims be construed to include alternative embodiments to the extent permitted by the prior art.

Changes may be made in the above methods and systems without departing from the scope hereof. It should thus be noted that the matter contained in the above description or shown in the accompanying drawings should be interpreted as illustrative and not in a limiting sense.

For example, the light emitting device may operate in DC mode or may also operate in a pulse mode. The light emitting device may operate with a minimum pulse length of 1 microsecond and a duty cycle of between 0.1% and 100%. For example, a pulse length of 1 microsecond and an off time of 10 milliseconds results in a duty cycle of 1%. Pulse mode may, for example, provide lower average current density at the phosphor and therefore increase the life of the light emitting device. In operation, an electric field of between 2 and 15 volts/micron is required, resulting in a current density of between 0 and 1 A/cm$^2$.

The following claims are intended to cover all generic and specific features described herein, as well as all statements of the scope of the present method and system, which, as a matter of language, might be said to fall there between.

What is claimed is:

1. A light emitting device, comprising:

an enclosure with a face portion;

a cold cathode having one electron source formed as a single emissive surface within the enclosure;

a phosphor layer disposed on an interior surface of the face portion;

an extracting grid disposed between the cold cathode and the phosphor layer; and a defocusing grid between the extracting grid and the phosphor layer;

a device controller for applying a first voltage to the cold cathode, a second voltage to the extraction grid, a third voltage to the defocusing grid and a fourth voltage to the phosphor layer, the second voltage causing electrons to be emitted substantially evenly across the emissive surface of the cold cathode, the third voltage defocusing the emitted electrons, and the fourth voltage accelerating the electrons to impact the phosphor layer and generate light that is emitted through the face portion.

2. The light emitting device of claim 1, the defocusing grid generating secondary electron emission due to electrons incident thereon.

3. The light emitting device of claim 1, the enclosure comprising glass.

4. The light emitting device of claim 1, the second and third voltages being substantially equal and the extraction grid being electrically coupled to the defocusing grid.

5. The light emitting device of claim 4, further comprising:

a first electrical conductor extending through the enclosure to apply the first voltage to the cold cathode;

a second electrical conductor extending through the enclosure to apply the second voltage to the extraction and to apply the third voltage to the defocusing grids; and a third electrical conductor extending through the enclosure to apply the fourth voltage to the phosphor layer.

6. The light emitting device of claim 1, further comprising a mirror layer disposed on the phosphor layer wherein the electrons pass through the mirror layer to impact the phosphor layer and wherein the mirror layer reflects the light emitted by the phosphor layer towards the face portion to increase intensity of light output by the light emitting device.

7. The light emitting device of claim 1, further comprising at least one tubulator between the defocusing grid and the phosphor layer, the tubulator increasing the number of electrons impacting the phosphor layer.

8. The light emitting device of claim 1, further comprising a device controller having at least one voltage generator for generating the first, second, third and fourth voltages.

9. The light emitting device of claim 8, wherein the device controller varies the voltage of one or more of the voltages to vary the brightness of light emitted from the light emitting device.

10. The light emitting device of claim 1, further comprising a getter material for maintaining a vacuum within the enclosure.

11. The light emitting device of claim 1, further comprising an active getter for establishing a vacuum within the enclosure.

12. The light emitting device of claim 1, further comprising an active getter for maintaining a vacuum within the enclosure.

13. The light emitting device of claim 1, wherein the single emissive surface of the cold cathode is formed by chemical vapor deposition.

14. A light emitting device, comprising:

an enclosure with a face portion;

a cold cathode having one electron source formed as a single emissive surface within the enclosure, the single emissive surface having a convex or concave shape;

a phosphor layer disposed on an interior surface of the face portion;

an extracting grid disposed between the cold cathode and the phosphor layer, the extracting grid having a convex or concave shape and formed to have a uniform distance from the single emissive surface of the cold cathode;

a device controller for applying a first voltage to the cold cathode, a second voltage to the extraction grid, a third voltage to the phosphor layer, the second voltage causing electrons to be emitted substantially evenly across the emissive surface of the cold cathode, and the third voltage accelerating the electrons to impact the phosphor layer and generate light that is emitted through the face portion.

15. The light emitting device of claim 14, the enclosure comprising glass.

16. The light emitting device of claim 14, further comprising:

a first electrical conductor extending through the enclosure to apply the first voltage to the cold cathode;

a second electrical conductor extending through the enclosure to apply the second voltage to the extraction grid; and a third electrical conductor extending through the enclosure to apply the third voltage to the phosphor layer.

17. The light emitting device of claim 14, further comprising a mirror layer disposed on the phosphor layer wherein the electrons pass through the mirror layer to impact the phosphor layer and wherein the mirror layer reflects the light emitted by the phosphor layer towards the face portion to increase intensity of light output by the light emitting device.

18. The light emitting device of claim 14, wherein the device controller varies the voltage of one or more of the first, second and third voltages to vary the brightness of light emitted from the light emitting device.

19. The light emitting device of claim 14, further comprising a getter material for maintaining a vacuum within the enclosure.

20. The light emitting device of claim 14, further comprising an active getter for establishing a vacuum within the enclosure.

21. The light emitting device of claim 14, further comprising an active getter for maintaining a vacuum within the enclosure.

22. The light emitting device of claim 14, wherein the single emissive surface of the cold cathode is formed by chemical vapor deposition.

23. A display system, comprising:

an array of light emitting devices;

a display controller electrically connected to each of the light emitting devices, wherein the display controller controls brightness of each of the light emitting device;

wherein each of the light emitting devices comprises:

an enclosure with a face portion;

a cold cathode having one electron source formed as a single emissive surface within the enclosure;

a phosphor layer disposed on an interior surface of the face portion;

an extracting grid disposed between the cold cathode and the phosphor layer;

a defocusing grid between the extracting grid and the phosphor layer and electrically coupled to the extracting grid;

a device controller for applying voltages such that electrons are emitted substantially evenly across the emissive surface of the cold cathode and are defocused by the defocusing grid and impact the phosphor layer, the phosphor layer emitting light through the face portion in response to impact of the electrons thereon.

24. A display system, comprising:

an array of light emitting devices, each light emitting device producing light of variable color and brightness;

a display controller electrically connected to each of the light emitting devices, wherein the display controller provides a plurality of electrical potentials to each of the light emitting devices to control color and brightness of the light emitting device;

wherein each of the light emitting devices comprises:

an enclosure with a face portion;

a cold cathode having one electron source formed as a single emissive surface within the enclosure;

a phosphor layer disposed on an interior surface of the face portion;

an extracting grid disposed between the cold cathode and the phosphor layer; and a defocusing grid between the extracting grid and the phosphor layer, the extracting grid electrically coupled to the defocusing grid;

a device controller for applying voltages to the cathode, extracting grid, and defocusing grid, such that electrons emitted substantially evenly across the emissive surface of the cold cathode are defocused by the defocusing grid and impact the phosphor layer, the phosphor layer emitting light through the face portion in response to impact of the electrons thereon.

25. The light emitting device of claim 1, the single emissive surface having an area between 0.3 square millimeter and 144 square millimeters.

26. The light emitting device of claim 14, the single emissive surface having an area between 0.3 square millimeter and 144 square millimeters.

27. The light emitting device of claim 23, the single emissive surface having an area between 0.3 square millimeter and 144 square millimeters.

28. The light emitting device of claim 24, the single emissive surface having an area between 0.3 square millimeter and 144 square millimeters.

29. The light emitting device of claim 1, wherein the single emissive surface is flat.

30. The light emitting device of claim 1, wherein the extraction grid is flat.

* * * * *